US011832643B2

(12) United States Patent
Hejazi et al.

(10) Patent No.: US 11,832,643 B2
(45) Date of Patent: Dec. 5, 2023

(54) SMOKING ARTICLE WITH HEAT TRANSFER COMPONENT

(71) Applicant: R.J. REYNOLDS TOBACCO COMPANY, Winston-Salem, NC (US)

(72) Inventors: Vahid Hejazi, Winston-Salem, NC (US); Billy T. Conner, Clemmons, NC (US); Paul E. Braxton, Summerfield, NC (US); Andries D. Sebastian, Clemmons, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 577 days.

(21) Appl. No.: 17/022,604

(22) Filed: Sep. 16, 2020

(65) Prior Publication Data

US 2021/0000176 A1 Jan. 7, 2021

Related U.S. Application Data

(62) Division of application No. 15/923,735, filed on Mar. 16, 2018, now Pat. No. 10,798,969.

(51) Int. Cl.
*A24D 1/22* (2020.01)
*A24D 1/04* (2006.01)
(Continued)

(52) U.S. Cl.
CPC ..... *A24D 1/22* (2020.01); *A24B 13/02* (2013.01); *A24B 15/12* (2013.01); *A24B 15/16* (2013.01);
(Continued)

(58) Field of Classification Search
None
See application file for complete search history.

(56) References Cited

U.S. PATENT DOCUMENTS 2,057,353 A 10/1936 Whittemore, Jr.
2,104,266 A 1/1938 McCormick
(Continued)

FOREIGN PATENT DOCUMENTS

CN 1541577 11/2004
CN 2719043 8/2005
(Continued)

OTHER PUBLICATIONS

International Search Report from the corresponding International Application No. PCT/IB2019/052101, dated Jul. 2, 2019.

*Primary Examiner* — Kelly M Gambetta
*Assistant Examiner* — Katherine A Will
(74) *Attorney, Agent, or Firm* — Womble Bond Dickinson (US) LLP

(57) ABSTRACT

Smoking articles are disclosed herein. The present disclosure is directed to a smoking article that comprises a heat source configured to generate heat upon ignition thereof, a substrate material having opposed first and second ends, the heat source being disposed proximate the first end of the substrate material and the substrate material having an aerosol precursor composition associated therewith, a mouthpiece, the mouthpiece being disposed proximate the second end of the substrate material, and a heat transfer component. In one implementation, the heat transfer component comprises a hollow structure and opposing first and second flanges located on respective ends thereof, wherein the hollow structure extends through the heat source such that the heat source is located between the first and second opposing flanges. In another implementation, the heat transfer component is located within the heat source, penetrates at least a portion of the substrate material, and includes a cap located between the heat source and the substrate material.

15 Claims, 11 Drawing Sheets

(51) Int. Cl.

| | |
|---|---|
| ***A24D 1/02*** | (2006.01) |
| ***A24B 13/02*** | (2006.01) |
| ***F28F 13/00*** | (2006.01) |
| ***A24B 15/16*** | (2020.01) |
| ***F28F 21/08*** | (2006.01) |
| ***A24B 15/12*** | (2006.01) |
| ***A24F 40/40*** | (2020.01) |

(52) U.S. Cl.

CPC ..... *A24B 15/165* (2013.01); *A24D 1/02* (2013.01); *A24D 1/04* (2013.01); *A24D 1/045* (2013.01); *A24F 40/40* (2020.01); *F28F 13/003* (2013.01); *F28F 21/084* (2013.01)

(56) References Cited

U.S. PATENT DOCUMENTS

| | | | |
|---|---|---|---|
| 3,200,819 | A | 8/1965 | Gilbert |
| 4,714,082 | A | 12/1987 | Banerjee et al. |
| 4,922,901 | A | 5/1990 | Brooks et al. |
| 5,060,671 | A | 10/1991 | Counts et al. |
| 5,093,894 | A | 3/1992 | Deevi et al. |
| 5,261,424 | A | 11/1993 | Sprinkel, Jr. |
| 5,388,574 | A | 2/1995 | Ingebrethsen et al. |
| 5,469,871 | A | 11/1995 | Barnes et al. |
| 5,530,225 | A | 6/1996 | Hajaligol |
| 5,551,451 | A | 9/1996 | Riggs et al. |
| 5,687,746 | A | 11/1997 | Rose et al. |
| 5,726,421 | A | 3/1998 | Fleischhauer et al. |
| 5,865,185 | A | 2/1999 | Collins et al. |
| 5,894,841 | A | 4/1999 | Voges |
| 6,125,853 | A | 10/2000 | Susa et al. |
| 6,155,268 | A | 12/2000 | Takeuchi |
| 7,117,867 | B2 | 10/2006 | Cox et al. |
| 7,647,932 | B2 | 1/2010 | Cantrell et al. |
| 7,832,410 | B2 | 11/2010 | Hon |
| 8,314,591 | B2 | 11/2012 | Terry et al. |
| 8,365,742 | B2 | 2/2013 | Hon |
| 8,499,766 | B1 | 8/2013 | Newton |
| 8,678,013 | B2 | 3/2014 | Crooks et al. |
| 9,532,591 | B2 | 1/2017 | Mironov |
| 9,578,897 | B2 | 2/2017 | Gladden et al. |
| 9,629,393 | B2 | 4/2017 | Stolz et al. |
| 9,717,273 | B2 | 8/2017 | Poget et al. |
| 9,730,468 | B2 | 8/2017 | Poget et al. |
| 9,801,412 | B2 | 10/2017 | Grant |
| 2005/0016550 | A1 | 1/2005 | Katase |
| 2006/0196518 | A1 | 9/2006 | Hon |
| 2008/0092912 | A1 | 4/2008 | Robinson et al. |
| 2009/0095311 | A1 | 4/2009 | Hon |
| 2009/0126745 | A1 | 5/2009 | Hon |
| 2009/0188490 | A1 | 7/2009 | Hon |
| 2009/0272379 | A1 | 11/2009 | Thorens et al. |
| 2010/0186757 | A1 | 7/2010 | Crooks |
| 2011/0088707 | A1 | 4/2011 | Hajaligol |
| 2011/0094523 | A1 | 4/2011 | Thorens et al. |
| 2011/0126848 | A1 | 6/2011 | Zuber et al. |
| 2011/0155718 | A1 | 6/2011 | Greim et al. |
| 2011/0168194 | A1 | 7/2011 | Hon |
| 2011/0265806 | A1 | 11/2011 | Alarcon et al. |
| 2011/0290248 | A1 | 12/2011 | Schennum |
| 2012/0042885 | A1 | 2/2012 | Stone |
| 2012/0067360 | A1 | 3/2012 | Conner et al. |
| 2012/0111347 | A1 | 5/2012 | Hon |
| 2012/0260927 | A1 | 10/2012 | Liu |
| 2012/0279512 | A1 | 11/2012 | Hon |
| 2013/0014755 | A1 | 1/2013 | Kumar et al. |
| 2013/0037041 | A1 | 2/2013 | Worm et al. |
| 2013/0056013 | A1 | 3/2013 | Terry et al. |
| 2013/0306084 | A1 | 11/2013 | Flick |
| 2014/0000638 | A1 | 1/2014 | Sebastian et al. |
| 2014/0060554 | A1 | 3/2014 | Collett et al. |
| 2014/0060555 | A1 | 3/2014 | Chang et al. |
| 2014/0096781 | A1 | 4/2014 | Sears et al. |
| 2014/0096782 | A1 | 4/2014 | Ampolini et al. |
| 2014/0209105 | A1 | 7/2014 | Sears et al. |
| 2014/0253144 | A1 | 9/2014 | Novak et al. |
| 2014/0261408 | A1 | 9/2014 | DePiano et al. |
| 2014/0261486 | A1 | 9/2014 | Potter et al. |
| 2014/0261487 | A1 | 9/2014 | Chapman et al. |
| 2014/0261495 | A1 | 9/2014 | Novak et al. |
| 2014/0270727 | A1 | 9/2014 | Ampolini et al. |
| 2014/0270729 | A1 | 9/2014 | DePiano et al. |
| 2014/0270730 | A1 | 9/2014 | DePiano et al. |
| 2015/0083150 | A1 | 3/2015 | Conner et al. |
| 2015/0157052 | A1 | 6/2015 | Ademe et al. |
| 2015/0209530 | A1 | 7/2015 | White |
| 2017/0000189 | A1 | 1/2017 | Mironov et al. |
| 2017/0055577 | A1 | 3/2017 | Batista |
| 2017/0181469 | A1 | 6/2017 | Poget et al. |
| 2017/0196261 | A1 | 7/2017 | Borges De Couraca et al. |
| 2017/0198228 | A1 | 7/2017 | Malgat et al. |
| 2017/0273352 | A1 | 9/2017 | Grant |
| 2017/0273353 | A1 | 9/2017 | Gindrat |
| 2017/0303585 | A1 | 10/2017 | Florack et al. |
| 2017/0318859 | A1 | 11/2017 | Batista |

FOREIGN PATENT DOCUMENTS

| | | | |
|---|---|---|---|
| CN | 201379072 | | 1/2010 |
| EP | 0 295 122 | | 12/1988 |
| EP | 0 845 220 | | 6/1998 |
| EP | 1 618 803 | | 1/2006 |
| EP | 2 676 559 | | 12/2013 |
| GB | 2469850 | | 11/2010 |
| JP | 2012-502658 | A | 2/2012 |
| JP | 2013-524850 | A | 6/2013 |
| JP | 2014-526275 | A | 10/2014 |
| RU | 2 195 849 | C2 | 1/2003 |
| WO | WO 98/28994 | | 7/1998 |
| WO | WO 2003/034847 | | 5/2003 |
| WO | WO 2004/080216 | | 9/2004 |
| WO | WO 2005/099494 | | 10/2005 |
| WO | WO 2007/131449 | | 11/2007 |
| WO | 2010/033665 | A1 | 3/2010 |
| WO | 2011/139730 | A1 | 11/2011 |
| WO | WO 2013/009883 | | 1/2013 |
| WO | 2013/043299 | A2 | 3/2013 |
| WO | WO 2015/070725 | | 5/2015 |
| WO | WO 2017/032784 | | 3/2017 |
| WO | WO 2017/037209 | | 3/2017 |
| WO | WO 2017/042297 | | 3/2017 |
| WO | WO 2017/042298 | | 3/2017 |
| WO | WO 2017/042389 | | 3/2017 |
| WO | WO 2017/108912 | | 7/2017 |
| WO | WO 2017/114683 | | 7/2017 |
| WO | WO 2017/114744 | | 7/2017 |
| WO | WO 2017/114760 | | 7/2017 |
| WO | WO 2017/114895 | | 7/2017 |
| WO | WO 2017/115181 | | 7/2017 |
| WO | WO 2017/115182 | | 7/2017 |
| WO | WO 2017/115183 | | 7/2017 |
| WO | WO 2017/115184 | | 7/2017 |
| WO | WO 2017/115185 | | 7/2017 |
| WO | WO 2017/115188 | | 7/2017 |
| WO | WO 2017/115196 | | 7/2017 |
| WO | 2017/132709 | A1 | 8/2017 |
| WO | WO 2017/207585 | | 12/2017 |
| WO | WO 2017/207672 | | 12/2017 |
| WO | WO 2017/207673 | | 12/2017 |

SMOKING ARTICLE WITH HEAT TRANSFER COMPONENT

CROSS-REFERENCE TO RELATED APPLICATIONS

This application is a divisional application of U.S. patent application Ser. No. 15/923,735, filed Mar. 16, 2018, the contents of which are incorporated herein by reference in its entirety.

FIELD OF THE DISCLOSURE

The present disclosure relates to aerosol delivery devices and systems, such as smoking articles; and more particularly, to aerosol delivery devices and systems that utilize combustible carbon-based ignition sources for the production of aerosol (e.g., smoking articles for purposes of yielding components of tobacco and other materials in an inhalable form, commonly referred to as heat-not-burn systems or electronic cigarettes). Components of such articles are made or derived from tobacco, or those articles can be characterized as otherwise incorporating tobacco for human consumption, and which are capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

Various manners and methods for assembling smoking articles that possess a plurality of sequentially arranged segmented components have been proposed. See, for example, the various types of assembly techniques and methodologies set forth in U.S. Pat. No. 5,469,871 to Barnes et al. and U.S. Pat. No. 7,647,932 to Crooks et al.; and U.S. Pat. App. Pub. Nos. 2010/0186757 to Crooks et al.; 2012/0042885 to Stone et al., and 2012/00673620 to Conner et al.; each of which is incorporated by reference herein in its entirety.

Representative products that resemble many of the attributes of traditional types of cigarettes, cigars or pipes have been marketed as ACCORD® by Philip Morris Incorporated; ALPHA™, JOYE 510™ and M4™ by InnoVapor LLC; CIRRUS™ and FLING™ by White Cloud Cigarettes; BLU™ by Fontem Ventures B.V.; COHITA™, COLIBRI™, ELITE CLASSIC™, MAGNUM™, PHANTOM™ and SENSE™ by EPUFFER® International Inc.; DUOPRO™, STORM™ and VAPORKING® by Electronic Cigarettes, Inc.; EGAR™ by Egar Australia; eGo-C™ and eGo-T™ by Joyetech; ELUSION™ by Elusion UK Ltd; EONSMOKE® by Eonsmoke LLC; FIN™ by FIN Branding Group, LLC; SMOKE® by Green Smoke Inc. USA; GREENARETTE™ by Greenarette LLC; HALLIGAN™, HENDU™, JET™, MAXXQ™, PINK™ and PITBULL™ by SMOKE STIK®; HEATBAR™ by Philip Morris International, Inc.; HYDRO IMPERIAL™ and LXE™ from Crown7; LOGIC™ and THE CUBAN™ by LOGIC Technology; LUCI® by Luciano Smokes Inc.; METRO® by Nicotek, LLC; NJOY® and ONEJOY™ by Sottera, Inc.; NO. 7™ by SS Choice LLC; PREMIUM ELECTRONIC CIGARETTE™ by PremiumEstore LLC; RAPP E-MYSTICK™ by Ruyan America, Inc.; RED DRAGON™ by Red Dragon Products, LLC; RUYAN® by Ruyan Group (Holdings) Ltd.; SF® by Smoker Friendly International, LLC; GREEN SMART SMOKER® by The Smart Smoking Electronic Cigarette Company Ltd.; SMOKE ASSIST® by Coastline Products LLC; SMOKING EVERYWHERE® by Smoking Everywhere, Inc.; V2CIGS™ by VMR Products LLC; VAPOR NINE™ by VaporNine LLC; VAPOR4LIFE® by Vapor 4 Life, Inc.; VEPPO™ by E-CigaretteDirect, LLC; VUSE® by R. J. Reynolds Vapor Company; Mistic Menthol product by Mistic Ecigs; and the Vype product by CN Creative Ltd.; IQOS™ by Philip Morris International; and GLO™ by British American Tobacco. Yet other electrically powered aerosol delivery devices, and in particular those devices that have been characterized as so-called electronic cigarettes, have been marketed under the tradenames COOLER VISIONS™; DIRECT E-CIG™; DRAGONFLY™; EMIST™; EVERSMOKE™; GAMUCCI®; HYBRID FLAME™; KNIGHT STICKS™; ROYAL BLUES™; SMOKETIP®; and SOUTH BEACH SMOKE™.

In some instances, traditional types of smoking articles, such as those referenced above, are difficult to assemble as a result of multiple components that must be disassembled and reassembled upon consumption of aerosol delivery components provided therein. In some other instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In particular, it would be desirable to provide a smoking article that reduces carbon monoxide carbon dioxide, and/or other harmful products of carbon combustion, and/or provides improved heat transfer to the aerosol forming components.

BRIEF SUMMARY

In various implementations, the present disclosure provides a smoking article. In one implementation, the smoking article may comprise a heat source configured to generate heat upon ignition thereof, a substrate material having opposed first and second ends, the heat source being disposed proximate the first end of the substrate material, and the substrate material having an aerosol precursor composition associated therewith, a mouthpiece, the mouthpiece being disposed proximate the second end of the substrate material, and a heat transfer component comprising a hollow structure and including opposing first and seconds flanges located on respective ends thereof. The hollow structure of the heat transfer component may extend through the heat source such that the heat source is located between the first and second opposing flanges of the heat transfer component, and the hollow structure may be configured to permit the passage of air therethrough.

In some implementations, the substrate material may comprise at least one of tobacco-containing beads, tobacco shreds, tobacco strips, pieces of a reconstituted tobacco material, tobacco rods, and non-tobacco materials. Some implementations may further comprise a liner configured to circumscribe the substrate material and at least a portion of the heat source. Some implementations may further comprise one or more perforations located in the substrate material, the perforations being configured to facilitate airflow through the smoking article. Some implementations may further comprise a second substrate material having opposed first and second ends, the second substrate material being disposed between the first substrate material and the mouthpiece. In some implementations, the second substrate material may comprise at least one of tobacco-containing beads, tobacco shreds, tobacco strips, pieces of a reconstituted tobacco material, or tobacco rods. In some implementations, the mouthpiece may comprise an intermediate component. In some implementations, the mouthpiece may comprise a filter. In some implementations, the heat source may comprise an extruded monolithic carbonaceous material. In some implementations, the extruded monolithic carbonaceous material may define one or more grooves extending longitudinally from a first end of the extruded monolithic carbonaceous material to an opposing second end of the extruded monolithic carbonaceous material.

In another implementation, the smoking article may comprise a heat source configured to generate heat upon ignition thereof, a substrate material having opposed first and second ends, the heat source being disposed proximate the first end of the substrate material, and the substrate material having an aerosol precursor composition associate therewith, a mouthpiece, the mouthpiece being disposed proximate the second end of the substrate material, and a heat transfer component located within the heat source. The heat transfer component may extend from the heat source and penetrate at least a portion of the substrate material, and the heat transfer component may include a cap located between the heat source and the substrate material. In some implementations, the heat transfer component may comprise one or more substantially close-ended structures. In some implementations, the one or more close-ended structures may be constructed of at least one of aluminum, and copper with an aluminum coating. In some implementations, the heat transfer component may comprise one or more substantially solid rods. In some implementations, the one or more substantially solid rods may be constructed of at least one of aluminum, and copper with an aluminum coating. In some implementations, the heat transfer component may comprise an aluminum mesh. In some implementations, the heat transfer component may further comprise an aluminum disc positioned at a location along a length of the aluminum mesh. In some implementations, the heat transfer component may comprise one or more substantially solid sheets. In some implementations, the one or more substantially solid sheets may be constructed of at least one of aluminum, and copper with an aluminum coating. In some implementations, the substrate material may comprise at least one of tobacco-containing beads, tobacco shreds, tobacco strips, pieces of a reconstituted tobacco material, or tobacco rods.

Some implementations may further comprise a liner configured to circumscribe the substrate material and at least a portion of the heat source. Some implementations may further comprise a second substrate material having opposed first and second ends, the second substrate material being disposed between the first substrate material and the mouthpiece. In some implementations, the second substrate material may comprise at least one of tobacco-containing beads, tobacco shreds, tobacco strips, pieces of a reconstituted tobacco material, or tobacco rods. In some implementations, the mouthpiece may comprise an intermediate component. In some implementations, the mouthpiece may comprise a filter. In some implementations, the heat source may comprise an extruded monolithic carbonaceous material. In some implementations, the extruded monolithic carbonaceous material may define one or more grooves extending longitudinally from a first end of the extruded monolithic carbonaceous material to an opposing second end of the extruded monolithic carbonaceous material.

These and other features, aspects, and advantages of the disclosure will be apparent from a reading of the following detailed description together with the accompanying drawings, which are briefly described below.

BRIEF DESCRIPTION OF THE DRAWINGS

Figure 1:
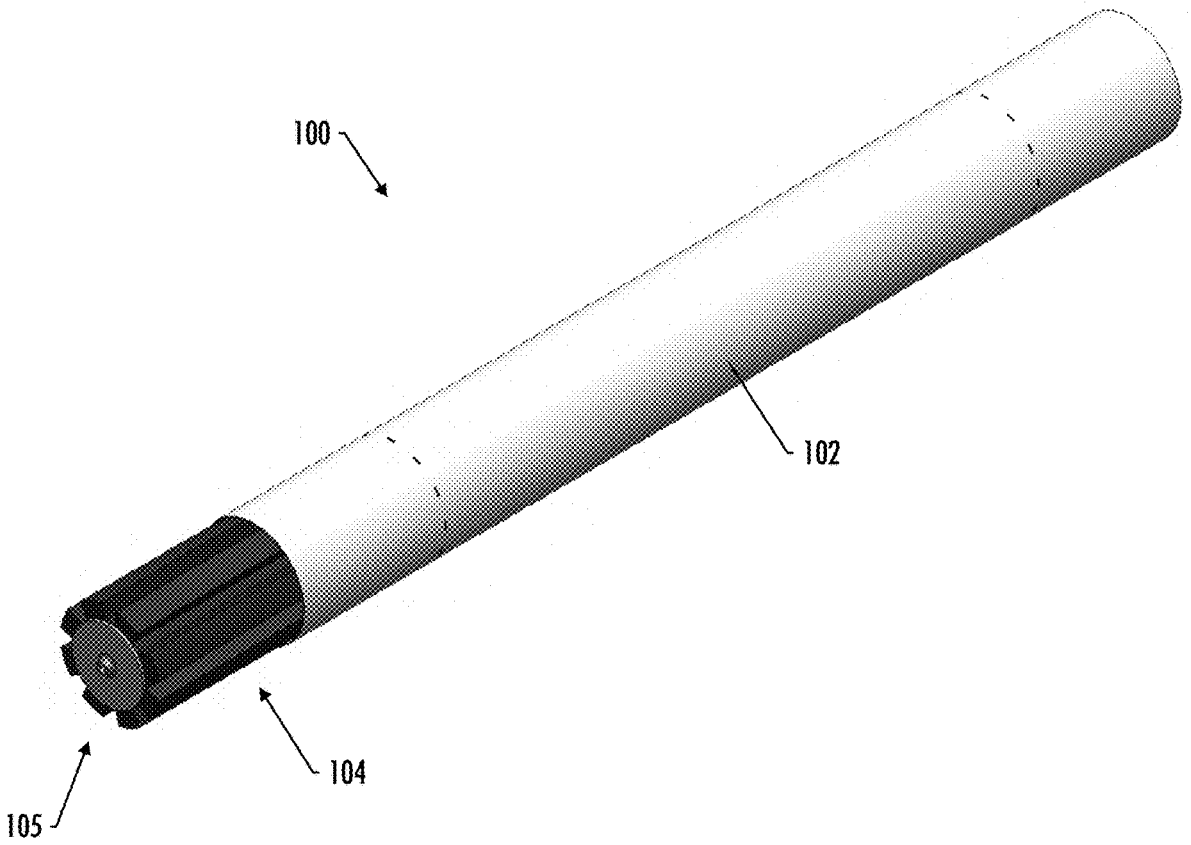
Figure 2:
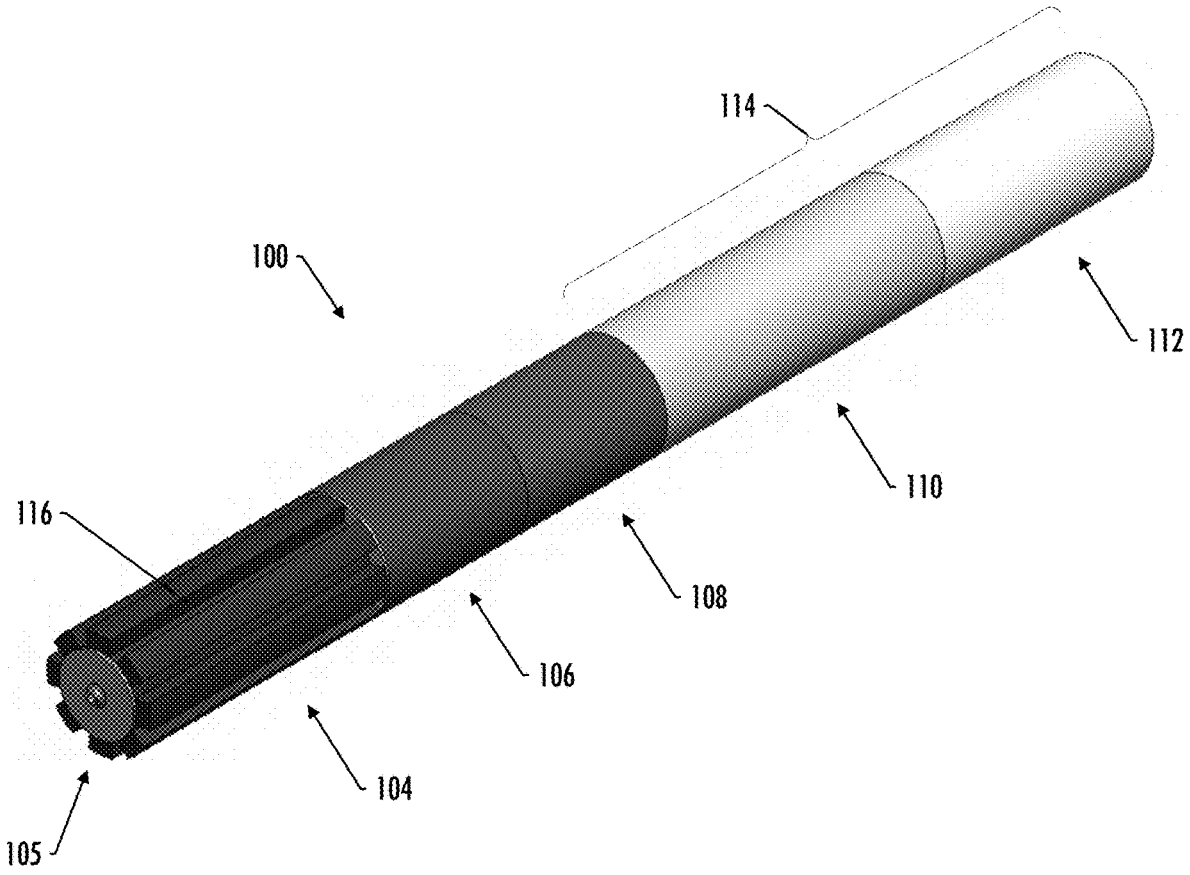
Figure 3:
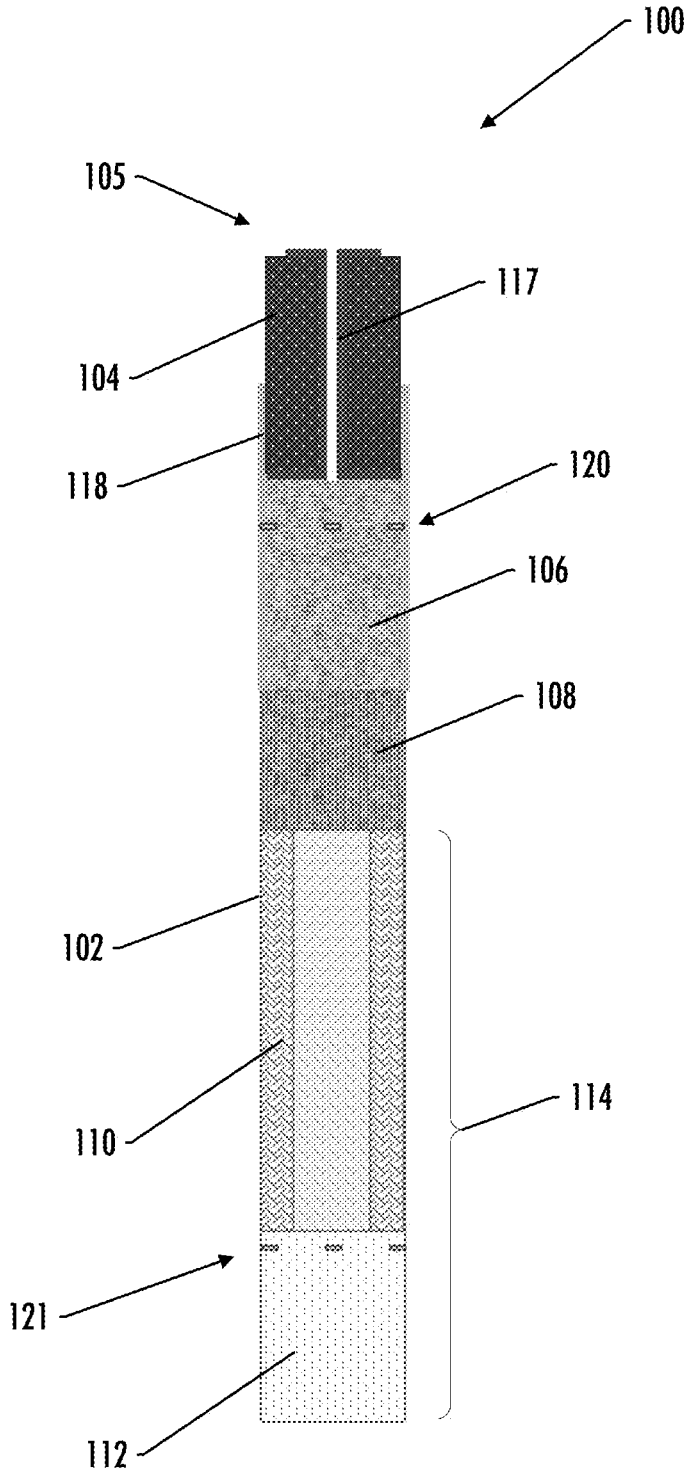
Figure 4:
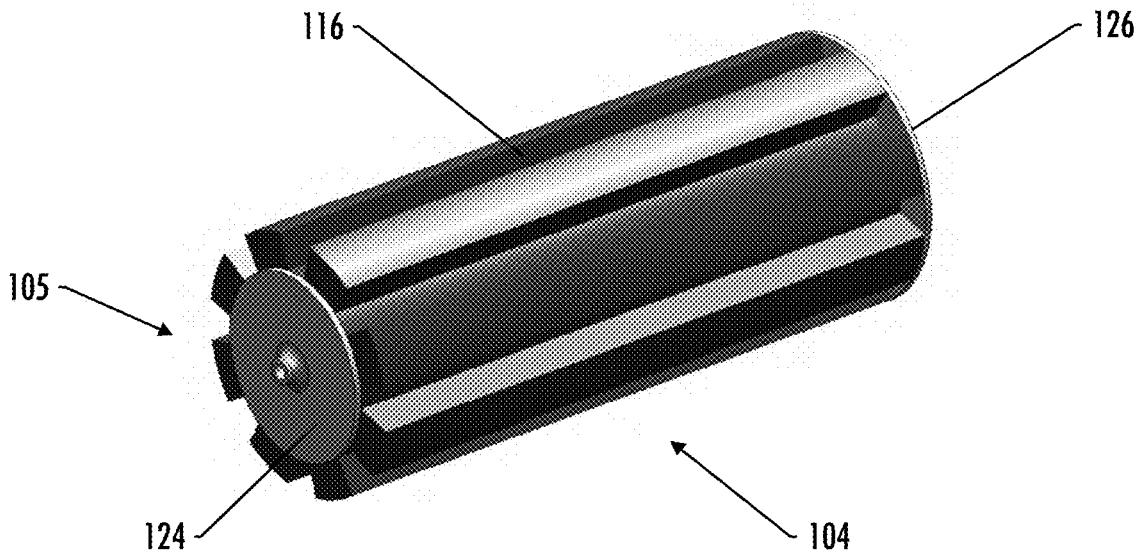
Figure 5:
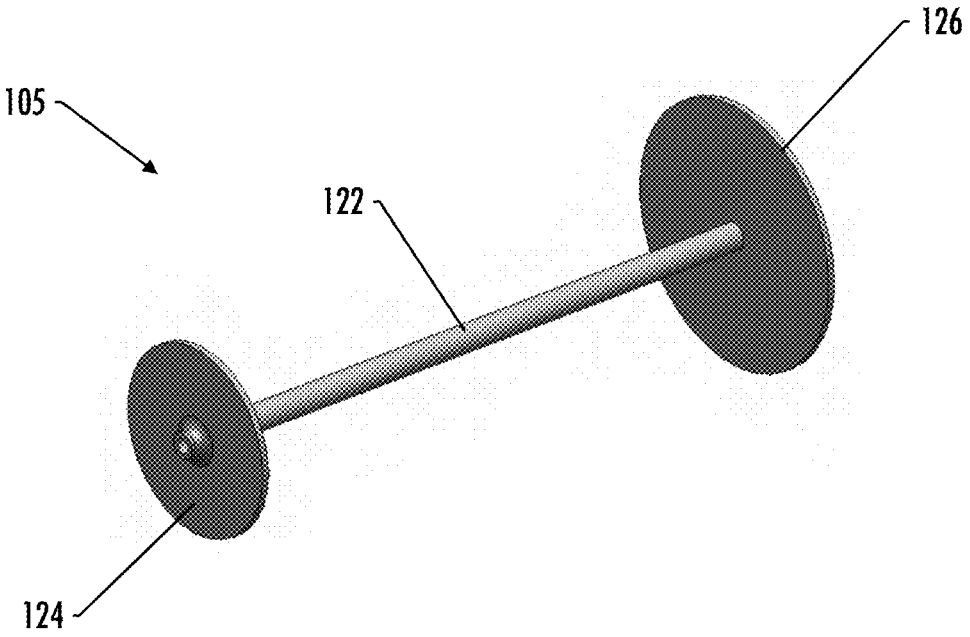
Figure 6:
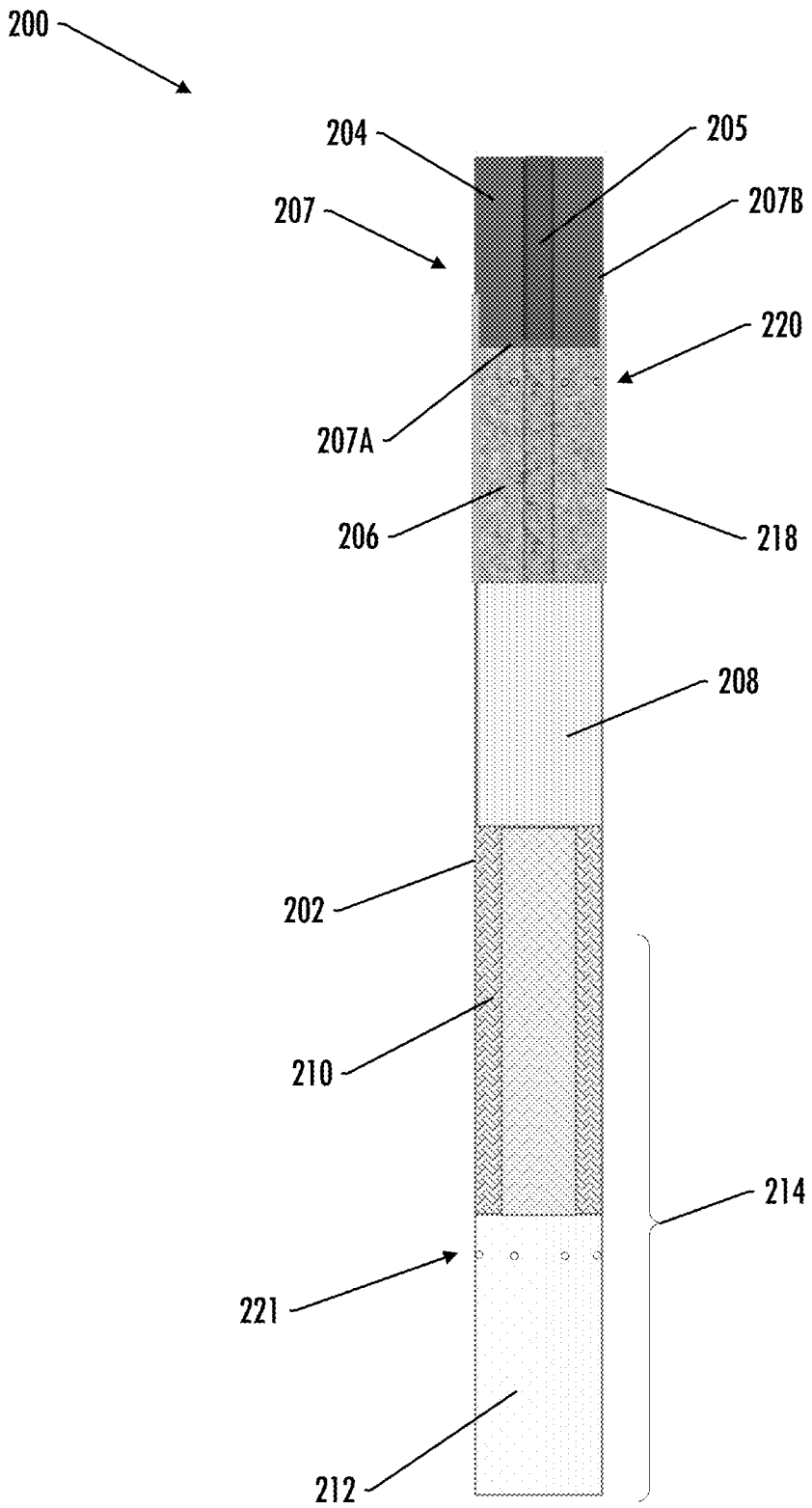
Figure 7:
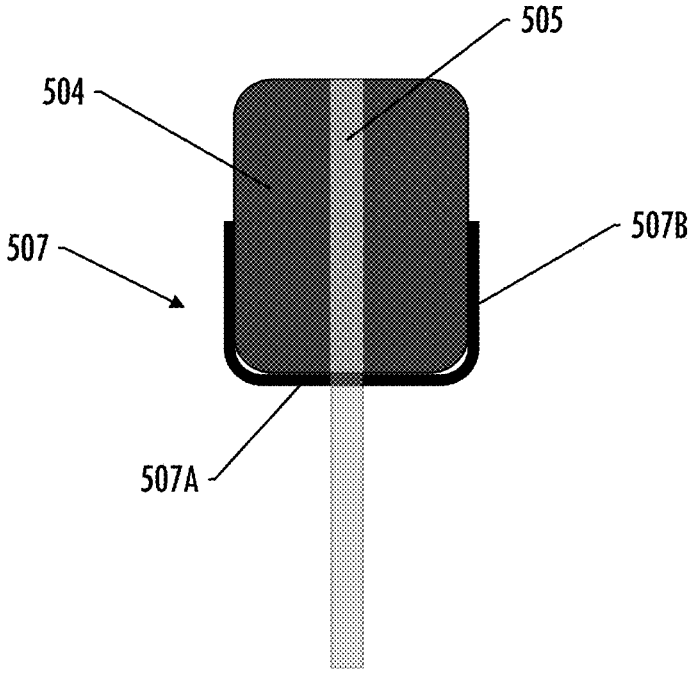
Figure 8:
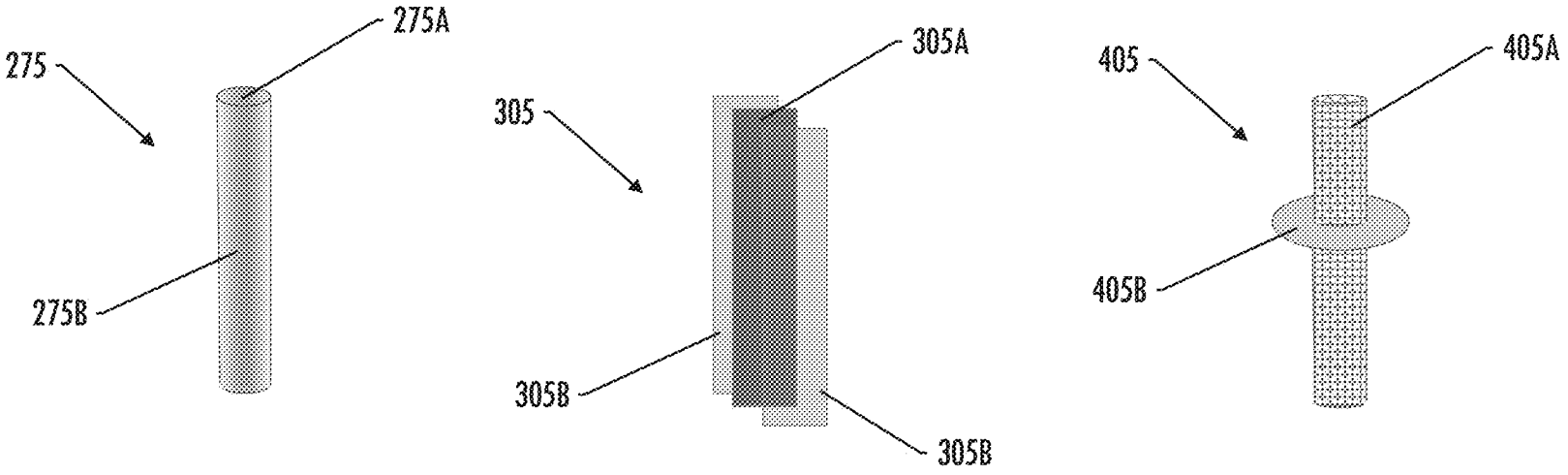
Figure 9:
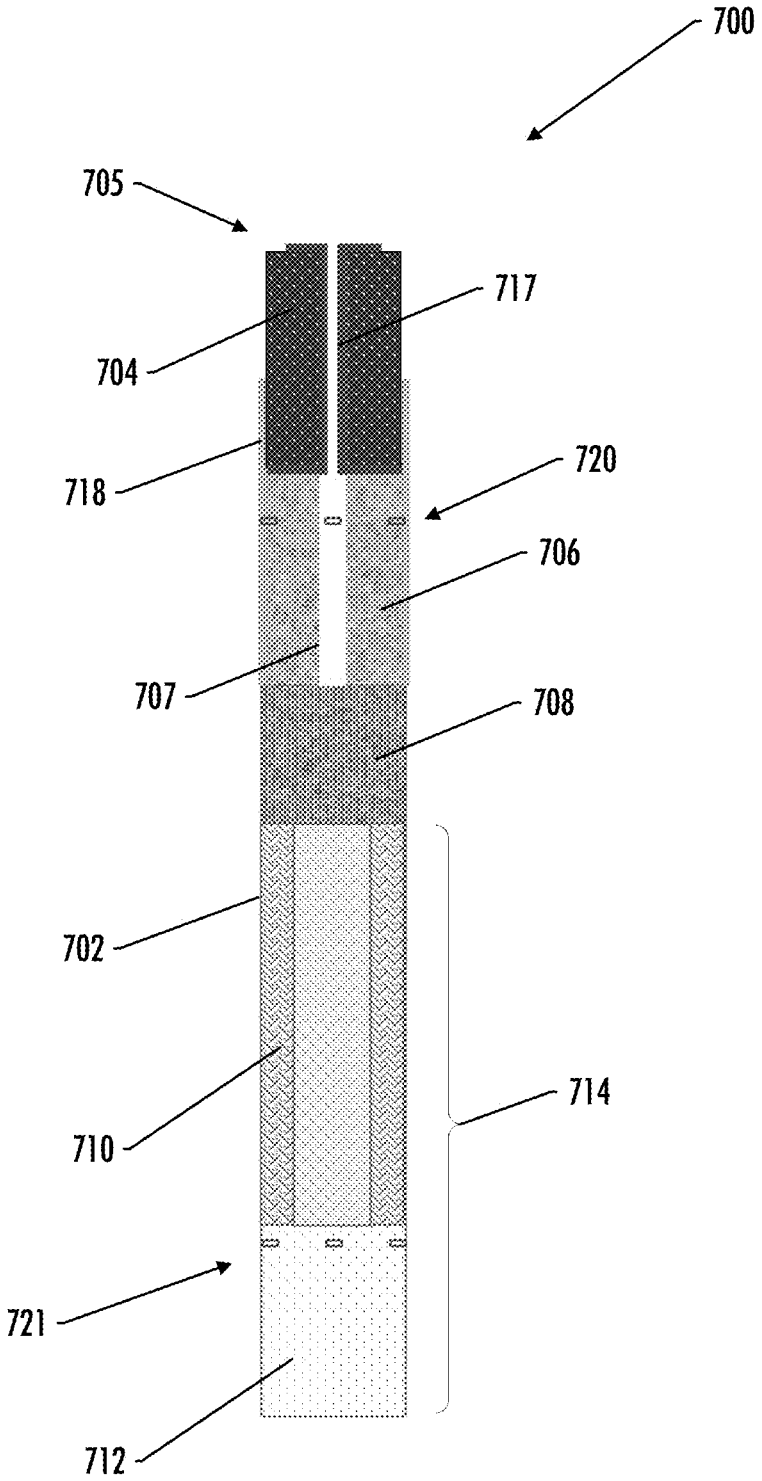
Figure 10:
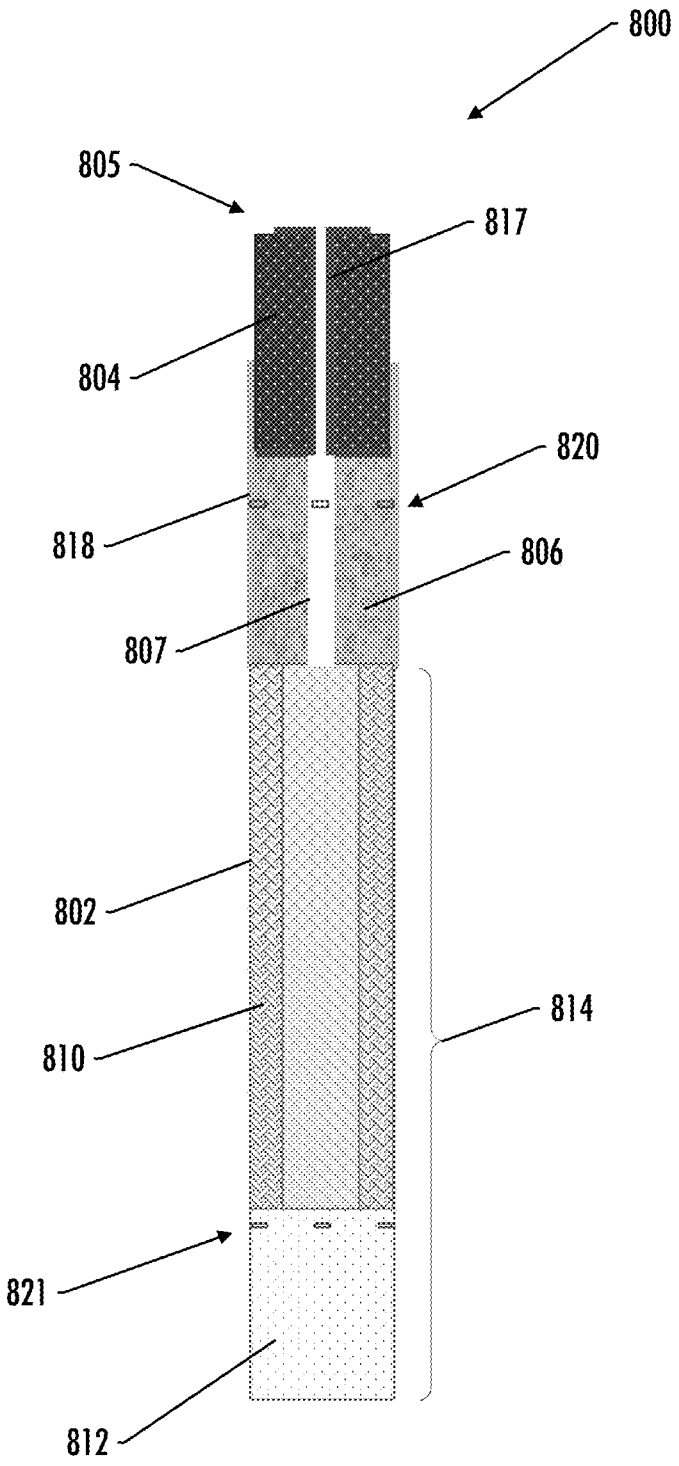
Figure 11:
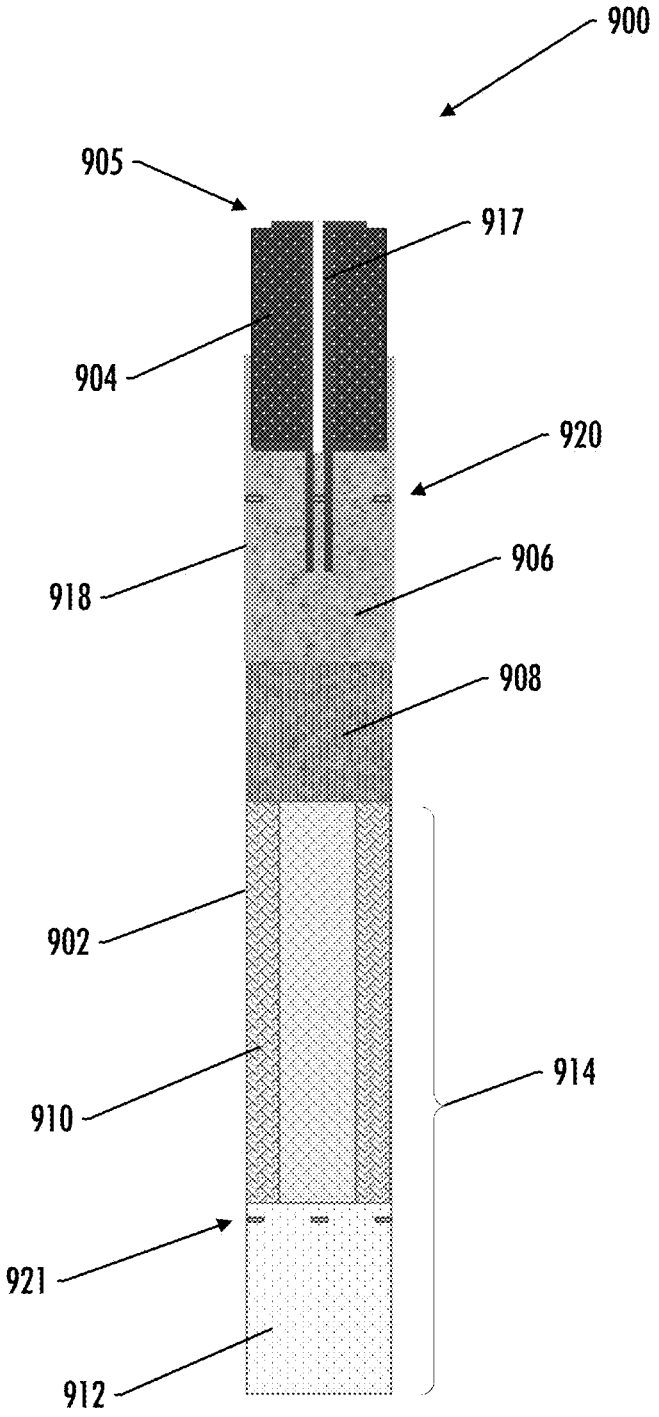

Having thus described the disclosure in the foregoing general terms, reference will now be made to the accompanying drawings, which are not necessarily drawn to scale, and wherein:

FIG. 1 illustrates a perspective view of a smoking article, according to one implementation of the present disclosure;

FIG. 2 illustrates a perspective view of the smoking article of FIG. 1 with an outer wrap removed, according to one implementation of the present disclosure;

FIG. 3 illustrates a longitudinal cross-section schematic view of the smoking article of FIG. 1, according to one implementation of the present disclosure;

FIG. 4 illustrates a perspective view of the heat source and heat transfer component of the smoking article of FIG. 1, according to one implementation of the present disclosure;

FIG. 5 illustrates a perspective view of the heat transfer component of the smoking article of FIG. 1, according to one implementation of the present disclosure;

FIG. 6 illustrates a longitudinal cross-section schematic view of a smoking article, according to one implementation of the present disclosure;

FIG. 7 illustrates a longitudinal cross-section schematic view of a heat source and a heat transfer component of a smoking article, according to one implementation of the present disclosure;

FIG. 8 illustrates schematic views of various heat transfer components of a smoking article, according to some example implementations of the present disclosure;

FIG. 9 illustrates a longitudinal cross-section schematic view of a smoking article, according to one implementation of the present disclosure;

FIG. 10 illustrates a longitudinal cross-section schematic view of a smoking article, according to one implementation of the present disclosure; and FIG. 11 illustrates a longitudinal cross-section schematic view of a smoking article, according to one implementation of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure is embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of articles (and the assembly and/or manufacture thereof) in which a material is heated (preferably without combusting the material to any significant degree) to form an aerosol and/or an inhalable substance; such articles most preferably being sufficiently compact to be considered "hand-held" devices. In preferred aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In preferred aspects, articles or devices characterized as smoking articles incorporate tobacco and/or components derived from tobacco.

Articles or devices of the present disclosure are also characterized as being vapor-producing articles, aerosol delivery articles, or medicament delivery articles. Thus, such articles or devices are adaptable so as to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "e-cigarettes" or "tobacco heating products," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Smoking articles of the present disclosure generally include a number of elements provided or contained within an enclosure of some sort, such as a housing, an outer wrap, or wrapping, a casing, a component, a module, a member, or the like. The overall design of the enclosure is variable, and the format or configuration of the enclosure that defines the overall size and shape of the smoking article is also variable. It is desirable, in some aspects, that the overall design, size, and/or shape of the enclosure resembles that of a conventional cigarette or cigar. Typically, an enclosure resembling the shape of a cigarette or cigar comprises three or more separable components, members, or the like that are engaged to form the enclosure. For example, such a smoking article may comprise, in some aspects, three separable components that include a mouthpiece component, an aerosol delivery component (such as, for example, a substrate material), and a heat source component. In various aspects, the heat source may be capable of generating heat to aerosolize a substrate material that comprises, for example, an extruded structure and/or substrate, a substrate material associated with an aerosol precursor composition, tobacco and/or a tobacco related material, such as a material that is found naturally in tobacco that is isolated directly from the tobacco or synthetically prepared, in a solid or liquid form (e.g., beads, sheets, shreds, a wrap), or the like. In some implementations, an extruded structure may comprise tobacco products or a composite of tobacco with other materials such as, for example, ceramic powder. In other implementations, a tobacco extract/slurry may be loaded into porous ceramic beads. Other implementations may use non-tobacco products. For example, in some implementations e-liquid-loaded porous beads/powders (ceramics) may be used. In other implementations, rods/cylinders made of extruded slurry of ceramic powder and e-liquid may be used.

According to certain aspects of the present disclosure, it may be advantageous to provide a smoking article that reduces carbon monoxide and/or carbon dioxide and/or other harmful products of carbon combustion, and/or provides improved heat transfer to the aerosol forming components. FIGS. 1 and 2 illustrate perspective views of such a smoking article. In particular, FIG. 1 illustrates a perspective view of a smoking article 100 that includes an outer wrap 102, and FIG. 2 illustrates the smoking article 100 wherein the outer wrap 102 and a liner 118 (described below) are removed to reveal the other components of the smoking article 100. Referring to FIG. 2, (in addition to an outer wrap 102 and a liner 118) the smoking article of the depicted implementation includes a heat source 104, a heat transfer component 105, a first inhalable substance medium 106, a second inhalable substance medium 108, an intermediate component 110, and a filter 112. In the depicted implementation, the intermediate component 110 and the filter 112 together comprise a mouthpiece 114.

Although a smoking article according to the disclosure may take on a variety of implementations, as discussed in detail below, the use of the smoking article by a consumer will be similar in scope. The foregoing description of use of the smoking article is applicable to the various implementations described through minor modifications, which are apparent to the person of skill in the art in light of the further disclosure provided herein. The description of use, however, is not intended to limit the use of the inventive article but is provided to comply with all necessary requirements of disclosure herein.

In various implementations, the heat source 104 may be configured to generate heat upon ignition thereof. In the depicted implementation, the heat source 104 comprises a combustible fuel element that has a generally cylindrical shape and that incorporates a combustible carbonaceous material. In other implementations, the heat source 104 may have a different shape, for example, a prism shape having a cubic or hexagonal cross-section. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source 104 may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate). Although specific dimensions of an applicable heat source may vary, in the depicted implementation, the heat source 104 has a length in an inclusive range of approximately 7 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm). Although in other implementations, the heat source may be constructed in a variety of ways, in the depicted implementation, the heat source 104 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties. Although in various implementations, the heat source may have a variety of forms, including, for example, a substantially solid cylindrical shape or a hollow cylindrical (e.g., tube) shape, the heat source 104 of the depicted implementation comprises an extruded monolithic carbonaceous material that has a generally cylindrical shape but with a plurality of grooves 116 extending longitudinally from a first end of the extruded monolithic carbonaceous material to an opposing second end of the extruded monolithic carbonaceous material. In the depicted implementation, the heat source 104 has a passageway 117 defined therethrough (see FIG. 3). As will be discussed in more detail below, in various implementations, the passageway 117 is configured to receive a portion of the heat transfer component 105.

Although in the depicted implementation, the grooves 116 of the heat source 104 are substantially equal in width and depth and are substantially equally distributed about a circumference of the heat source 104, other implementations may include as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety.

Generally, the heat source is positioned sufficiently near an aerosol delivery component (e.g., a substrate material) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

FIG. 3 illustrates a longitudinal cross-sectional schematic view of the smoking article 100 of FIG. 1, according to one implementation of the present disclosure. In various implementations, the outer wrap 102 (shown most clearly in FIG. 1) is provided to engage or otherwise join together at least a portion of the heat source 104 with the first substrate material 106, the second substrate material 108, and at least a portion of the mouthpiece 114. As such, the outer wrap material 102 is configured, in some aspects, to circumscribe, e.g., coaxially encircle, at least a portion of the heat source 104, the first substrate material 106 engaged about the first end thereof with the heat source 104, the second substrate material 108 engaged with the second end of the first substrate material 106, and at least a portion of the mouthpiece 114. The outer wrap 102 is configured to be retained in a wrapped position in any manner of ways including via an adhesive, or a fastener, and the like, to allow the outer wrap 102 to remain in the wrapped position. Otherwise, in some other aspects, the outer wrap 102 may be configured to be removable as desired. For example, upon retaining the outer wrap 102 in a wrapped position, the outer wrap 102 may be able to be removed from the heat source 104, the first substrate material 106 engaged with the heat source 104 about the first end thereof, the second substrate material 108 engaged with the second end of the first substrate material 106, and/or the mouthpiece 114.

As shown in the figure, in addition to the outer wrap 102, the depicted implementation also includes a liner 118 that is configured to circumscribe the first substrate material 106 and at least a portion of the heat source 104. Although in other implementations the liner 118 may circumscribe only a portion of the length of the first substrate material 106, in some implementations, the liner 118 may also circumscribe the second substrate material 108. In some implementations, the outer wrap material 102 may include the liner 118. As such, in some implementations the outer wrap material 102 and the liner 118 may be separate materials that are provided together (e.g., bonded, fused, or otherwise joined together as a laminate). In other implementations, the outer wrap 102 and the liner 118 may be the same material. In any event, the liner 118 may be configured to thermally regulate conduction of the heat generated by the ignited heat source 104, radially outward of the liner 118. As such, in some implementations, the liner 118 may be constructed of a metal foil material, a graphene material, a graphite material or other thermally conductive carbon-based material, and/or an aluminum material, and in some implementations may comprise a laminate. In the depicted implementation, the liner 118 is constructed of an aluminum laminate. In some implementations, depending on the material of the outer wrap 102 and/or the liner 118, a thin layer of insulation may be provided radially outward of the liner 118. Thus, the liner 118 may advantageously provide, in some aspects, a manner of engaging two or more separate components of the smoking article 100 (such as, for example, the heat source 104 and the first substrate material 106), while also providing a manner of facilitating heat transfer axially therealong, but restricting radially outward heat conduction.

As also shown in FIG. 3, the outer wrap 102 (and, as necessary, the liner 118, and the first substrate material 106) may also include one or more openings 120 formed therethrough that allow the entry of air upon a draw on the mouthpiece 114. In various implementations, the size and number of these openings may be tuned such that a larger fraction of the drawn airflow occurs through these openings (and, in some implementations, a higher air flowrate) and a smaller fraction of the airflow occurs through the hollow structure (and, in some implementations, a lower air flowrate) described below. In such a manner, the airflow through the hollow structure may be only, or mostly, for promoting the heat transfer. In some implementations, the openings 120 may be located between the distal end of the heat transfer component 105 and the first substrate material 106. In some implementations, the openings 120 may be formed in the outer wrap 102 (and, in some implementations, the liner 118) in an area proximate the first substrate material 106, and one or more separate cooling openings 121 may be formed in the outer wrap 102 (and, in some implementations, the liner 118) in an area proximate the filter 112. In the depicted implementation, a plurality of substantially evenly spaced openings 120 are formed in the outer wrap 102 and liner 118 in an area proximate the first substrate material 106, and a plurality of substantially evenly spaced separate cooling openings 121 are formed in the outer wrap 102 in an area proximate the mouthpiece 114 (e.g., proximate the filter 112). Although in various implementations the plurality of openings may be formed through the outer wrap 102 (and the liner 118) in a variety of ways, in the depicted implementation, the plurality of openings 120 and the plurality of separate cooling openings 121 are formed via laser perforation.

FIG. 4 illustrates a perspective view of the heat source 104 and heat transfer component 105 of the smoking article 100 of FIG. 1, according to one implementation of the present disclosure. FIG. 5 illustrates a perspective view of the heat transfer component 105 of the smoking article 100 of FIG. 1, according to one implementation of the present disclosure. In particular, FIG. 4 illustrates that the heat transfer component 105 includes a hollow structure 122 with a first flange 124 located proximate one end thereof, and a second flange 126 located proximate a second end thereof. As illustrated in FIGS. 3 and 4, the heat source 105 is located between the first flange 124 and second flange 126 such that the hollow structure 122 of the heat transfer component 105 (see FIG. 5) extends through the heat source 104, and in particular, through the passageway 117 of the heat source 104. Although in the depicted implementation, the hollow structure is shown in the form of a hollow tube, in other implementations, the hollow structure may have any other, non-cylinder hollow shapes. In the depicted implementation, the hollow structure 122, the first flange 124, and the second flange 126 of the heat transfer component 105 are constructed of aluminum. In other implementations, however, any one or any combination of these parts may be constructed of another heat conducting material, including, for example, stainless steel, brass, copper, silver, gold, bronze, graphite, ceramics (e.g., alumina, beryllia, boron nitride, aluminum nitride, silicon carbide, etc.), and/or combinations thereof. Moreover, any one or any combination of these parts may be constructed of one or more than one material (e.g., one conductive material) and coated with other materials (e.g., another conductive material).

In the depicted implementation, the first flange 124 and the second flange 126 are attached to the hollow structure 122 proximate respective ends thereof using a laser weld and/or brazing/soldering. In other implementations, however, other attachment and/or construction methods may be used. For example, in some implementations, the heat transfer component 105 may be constructed of a single part. In other implementations, one or more adhesives and/or other mechanical attachment means (e.g., a press fit or threaded engagement) may be used. In some implementations, the thickness of the flanges 124, 126 may be in an inclusive range of approximately 0.05 mm to approximately 1 mm, and in some implementations may be approximately 0.1 mm-0.2 mm, the internal diameter of the hollow structure 122 may be in an inclusive range of approximately 0.1 mm to approximately 3 mm, and in some implementations may be approximately 0.3 mm-0.7 mm, and the hollow structure 122 wall thickness may be in an inclusive range of approximately 0.05 mm to approximately 1 mm, and in some implementations, may be approximately 0.1-0.2 mm. It should be noted that although the flanges of the depicted implementation have a substantially circular profile, in other implementations, one or both of the flanges may have other shapes, including, for example, substantially oval profiles and/or substantially polygonal profiles, such as, for example, triangular, rectangular, square, pentagonal, hexagonal, heptagonal, octagonal, etc. profiles.

In one implementation, the diameter (in other implementations, the overall size) of the first flange 124 may be approximately equal to the outer diameter of the heat source; however, in other implementations (such as the implementation depicted in FIG. 3) the diameter of the first flange 122 may be smaller than the outer diameter of the heat source 104. As will be discussed below, such a configuration may promote air circulation in the grooves of the heat source 104. In still other implementations, the diameter of the first flange 122 may be larger than the outer diameter of the heat source 104. In various implementations, the diameter of the first flange 124 may be between ⅓ to 4/3 times of the diameter of the heat source 104. In the depicted implementation, the diameter of the first flange 124 may be approximately ¾ times the diameter size of the heat source 104. Although in some implementations, the diameter of the second flange 126 may vary, in the depicted implementation the diameter of the second flange 126 is approximately the same as the outer diameter of the heat source 104. In addition, in various implementations the length of the hollow structure 122 may be at least as long as the length of the heat source 104, and in some implementations, may extend into the first substrate material 106 (see e.g., FIG. 11), and, in still other implementations, may further extend into the second substrate material 108.

In various implementations, the hollow structure 122 of the heat transfer component may be open on its ends, such that air may flow through the hollow structure 122. In such a manner, when a user takes a drag on the mouthpiece 114 of the smoking article 100, air may travel through the heat transfer component 105. In such a manner, air traveling through the hollow structure 122 may be in addition to air entering the smoking article 100 through the openings 120 formed through the outer wrap 102 (and, as necessary, the liner 118) proximate the first substrate material 106 and the mouthpiece 114. As such, in addition to the heat transfer functions provided by the structure of the heat transfer component 105, wherein the heat transfer component 105 facilitates the transfer of heat from the heat source 104 to the first substrate material 106 through conduction (and/or subsequent substrate materials, such as, for example, the second substrate material 108), the passage of air through the hollow structure 122 of the heat transfer component 105 during a drag on the smoking article 100 further facilitates transfer of heat from the heat source 104 to the first substrate material 106 (and/or subsequent substrate materials) through convection. It should be noted that in still other implementations, the hollow structure 122 connecting the first and second flanges 124, 126 need not be hollow, and thus a solid connecting piece (e.g., a solid cylinder) may be used to connect the first and second flanges 124, 126. In such implementations, air would not pass through the heat transfer component.

In the depicted implementation, the smoking article 100 also includes a first substrate material 106 having opposed first and second ends, wherein the first end is disposed proximate the heat transfer component 105. Although various implementations may only include one substrate material, in the depicted implementation, a second substrate material 108 is disposed proximate the second end of the first substrate material 106. In other implementations, additional substrate materials may be included. In various implementations, one or more of the substrate materials may include a tobacco or tobacco related material, with an aerosol precursor composition associated therewith. Other possible compositions, components, and/or additives for use in a substrate material (and/or substrate materials) are described in more detail below. It should be noted that the subsequent discussion should be applicable any substrate material usable in the smoking articles described herein (such as, for example, the first substrate material 106 and/or the second substrate material 108, individually or together).

In some implementations, the substrate material may comprise a blend of flavorful and aromatic tobaccos in cut filler form. In another implementation, the substrate material may comprise a reconstituted tobacco material, such as described in U.S. Pat. No. 4,807,809 to Pryor et al.; U.S. Pat. No. 4,889,143 to Pryor et al. and U.S. Pat. No. 5,025,814 to Raker, the disclosures of which are incorporated herein by reference in their entirety. Additionally, a reconstituted tobacco material may include a reconstituted tobacco paper for the type of cigarettes described in Chemical and Biological Studies on New Cigarette Prototypes that Heat Instead of Burn Tobacco, R. J. Reynolds Tobacco Company Monograph (1988), the contents of which are incorporated herein by reference in its entirety. For example, a reconstituted tobacco material may include a sheet-like material containing tobacco and/or tobacco-related materials. As such, in some implementations, the substrate material may be formed from a wound roll of a reconstituted tobacco material. In another implementation, the substrate material may be formed from shreds, strips, and/or the like of a reconstituted tobacco material. In another implementation, the tobacco sheet may comprise overlapping layers (e.g., a gathered web), which may, or may not, include heat conducting constituents. Examples of substrate portions that include a series of overlapping layers (e.g., gathered webs) of an initial substrate sheet formed by the fibrous filler material, aerosol forming material, and plurality of heat conducting constituents are described in U.S. patent application Ser. No. 15/905,320, filed on Feb. 26, 2018, and titled Heat Conducting Substrate For Electrically Heated Aerosol Delivery Device, which is incorporated herein by reference in its entirety.

In some implementations, the substrate material may include a plurality of microcapsules, beads, granules, and/or the like having a tobacco-related material. For example, a representative microcapsule may be generally spherical in shape, and may have an outer cover or shell that contains a liquid center region of a tobacco-derived extract and/or the like. In some implementations, one or more of the substrate materials may include a plurality of microcapsules each formed into a hollow cylindrical shape. In some implementations, one or more of the substrate materials may include a binder material configured to maintain the structural shape and/or integrity of the plurality of microcapsules formed into the hollow cylindrical shape.

Tobacco employed in one or more of the substrate materials may include, or may be derived from, tobaccos such as flue-cured tobacco, burley tobacco, Oriental tobacco, Maryland tobacco, dark tobacco, dark-fired tobacco and *Rustica* tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Pat. App. Pub. No. 2004/0255965 to Perfetti et al.; PCT Pub. No. WO 02/37990 to Bereman; and Bombick et al., *Fund. Appl. Toxicol.,* 39, p. 11-17 (1997); the disclosures of which are incorporated herein by reference in their entireties.

In still other implementations of the present disclosure, the substrate material may be configured as an extruded structure that includes, or is essentially comprised of a tobacco, a tobacco related material, glycerin, water, and/or a binder material, although certain formulations may exclude the binder material. In various implementations, suitable binder materials may include alginates, such as ammonium alginate, propylene glycol alginate, potassium alginate, and sodium alginate. Alginates, and particularly high viscosity alginates, may be employed in conjunction with controlled levels of free calcium ions. Other suitable binder materials include hydroxypropylcellulose such as Klucel H from Aqualon Co.; hydroxypropylmethylcellulose such as Methocel K4MS from The Dow Chemical Co.; hydroxyethylcellulose such as Natrosol 250 MRCS from Aqualon Co.; microcrystalline cellulose such as Avicel from FMC; methylcellulose such as Methocel A4M from The Dow Chemical Co.; and sodium carboxymethylcellulose such as CMC 7HF and CMC 7H4F from Hercules Inc. Still other possible binder materials include starches (e.g., corn starch), guar gum, carrageenan, locust bean gum, pectins and xanthan gum. In some implementations, combinations or blends of two or more binder materials may be employed. Other examples of binder materials are described, for example, in U.S. Pat. No. 5,101,839 to Jakob et al.; and U.S. Pat. No. 4,924,887 to Raker et al., each of which is incorporated herein by reference in its entirety. In some implementations, the aerosol forming material may be provided as a portion of the binder material (e.g., propylene glycol alginate). In addition, in some implementations, the binder material may comprise nanocellulose derived from a tobacco or other biomass.

In some implementations, the substrate material may be configured as an extruded material, as described in U.S. Pat. App. Pub. No. 2012/0042885 to Stone et al., which is incorporated herein by reference in its entirety. In yet another implementation, the substrate material may include an extruded structure and/or substrate formed from marumarized and/or non-marumarized tobacco. Marumarized tobacco is known, for example, from U.S. Pat. No. 5,105,831 to Banerjee, et al., which is incorporated by reference herein in its entirety. Marumarized tobacco includes about 20 to about 50 percent (by weight) tobacco blend in powder form, with glycerol (at about 20 to about 30 percent weight), calcium carbonate (generally at about 10 to about 60 percent by weight, often at about 40 to about 60 percent by weight), along with binder agents, as described herein, and/or flavoring agents. In various implementations, the extruded material may have one or more longitudinal openings.

In various implementations, the substrate material may take on a variety of conformations based upon the various amounts of materials utilized therein. For example, a sample substrate material may comprise up to approximately 98% by weight, up to approximately 95% by weight, or up to approximately 90% by weight of a tobacco and/or tobacco related material. A sample substrate material may also comprise up to approximately 25% by weight, approximately 20% by weight, or approximately 15% by weight water—particularly approximately 2% to approximately 25%, approximately 5% to approximately 20%, or approximately 7% to approximately 15% by weight water. Flavors and the like (which include, for example, medicaments, such as nicotine) may comprise up to approximately 10%, up to about 8%, or up to about 5% by weight of the aerosol delivery component.

Additionally or alternatively, the substrate material may be configured as an extruded structure and/or a substrate that includes or essentially is comprised of tobacco, glycerin, water, and/or binder material, and is further configured to substantially maintain its structure throughout the aerosol-generating process. That is, the substrate material may be configured to substantially maintain its shape (e.g., the substrate material does not continually deform under an applied shear stress) throughout the aerosol-generating process. Although such an example substrate material may include liquids and/or some moisture content, the substrate may remain substantially solid throughout the aerosol-generating process and may substantially maintain structural integrity throughout the aerosol-generating process. Example tobacco and/or tobacco related materials suitable for a substantially solid substrate material are described in U.S. Pat. App. Pub. No. 2015/0157052 to Ademe et al.; U.S. Pat. App. Pub. No. 2015/0335070 to Sears et al.; U.S. Pat. No. 6,204,287 to White; and U.S. Pat. No. 5,060,676 to Hearn et al., which are incorporated herein by reference in their entirety.

In some implementations, the amount of substrate material that is used within the smoking article may be such that the article exhibits acceptable sensory and organoleptic properties, and desirable performance characteristics. For example, in some implementations an aerosol precursor composition such as, for example, glycerin and/or propylene glycol, may be employed within the substrate material in order to provide for the generation of a visible mainstream aerosol that in many regards resembles the appearance of tobacco smoke. For example, the amount of aerosol precursor composition incorporated into the substrate material of the smoking article may be in the range of about 3.5 grams or less, about 3 grams or less, about 2.5 grams or less, about 2 grams or less, about 1.5 grams or less, about 1 gram or less, or about 0.5 gram or less.

According to another implementation, a smoking article according to the present disclosure may include a substrate material comprising a porous, inert material such as, for example, a ceramic material. For example, in some implementations ceramics of various shapes and geometries (e.g., beads, rods, tubes, etc.) may be used, which have various pore morphology. In addition, in some implementations non-tobacco materials, such as e-liquids, may be loaded into the ceramics. In another implementation, the substrate material may include a porous, inert material that does not substantially react, chemically and/or physically, with a tobacco-related material such as, for example, a tobacco-derived extract. In addition, an extruded tobacco, such as those described above, may be porous. For example, in some implementations an extruded tobacco material may have an inert gas, such as, for example, nitrogen, that acts as a blowing agent during the extrusion process.

As noted above, in various implementations one or more of the substrate materials may include a tobacco, a tobacco component, and/or a tobacco-derived material that has been treated, manufactured, produced, and/or processed to incorporate an aerosol precursor composition (e.g., humectants such as, for example, propylene glycol, glycerin, and/or the like) and/or at least one flavoring agent, as well as a flame/burn retardant (e.g., diammonium phosphate and/or another salt) configured to help prevent ignition, pyrolysis, combustion, and/or scorching of the substrate material by the heat source. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

As noted, in some implementations, flame/burn retardant materials and other additives that may be included within one or more of the substrate materials and may include organo-phosophorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides are suitable but are not preferred agents. In each aspect of flame-retardant, burn-retardant, and/or scorch-retardant materials used in the substrate material and/or other components (whether alone or in combination with each other and/or other materials), the desirable properties most preferably are provided without undesirable off-gassing or melting-type behavior.

According other implementations of the present disclosure, the substrate material may also incorporate tobacco additives of the type that are traditionally used for the manufacture of tobacco products. Those additives may include the types of materials used to enhance the flavor and aroma of tobaccos used for the production of cigars, cigarettes, pipes, and the like. For example, those additives may include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials may include water, sugars and syrups (e.g., sucrose, glucose and high fructose corn syrup), humectants (e.g. glycerin or propylene glycol), and flavoring agents (e.g., cocoa and licorice). Those added components may also include top dressing materials (e.g., flavoring materials, such as menthol). See, for example, U.S. Pat. No. 4,449,541 to Mays et al., the disclosure of which is incorporated herein by reference in its entirety. Further materials that may be added include those disclosed in U.S. Pat. No. 4,830,028 to Lawson et al. and U.S. Pat. No. 8,186,360 to Marshall et al., the disclosures of which are incorporated herein by reference in their entireties.

As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The substrate material may be chemically simple relative to the chemical nature of the smoke produced by burning tobacco.

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

Flavoring agents may also include acidic or basic characteristics (e.g., organic acids, such as levulinic acid, succinic acid, and pyruvic acid). In some implementations, flavoring agents may be combinable with the elements of the substrate material if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material. For example, organic acids, such as levulinic acid, lactic acid, and pyruvic acid, may be included in the substrate material with nicotine in amounts up to being equimolar (based on total organic acid content) with the nicotine. Any combination of organic acids may be suitable. For example, in some implementations, the substrate material may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the substrate material. Various additional examples of organic acids employed to produce a substrate material are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the first substrate material may include other materials having a variety of inherent characteristics or properties. For example, the substrate material may include a plasticized material or regenerated cellulose in the form of rayon. As another example, viscose (commercially available as VISIL®), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

Referring back to FIGS. 1 and 2, in the smoking article 100 of the depicted implementation, the first substrate material 106 comprises a plurality of tobacco beads formed into a substantially cylindrical portion. Although, as noted above, in various implementations the size and shape of the first substrate material may vary, for example in some implementations the first substrate material 106 may have a length in an inclusive range of approximately 5 mm to approximately 15 mm, and an overall diameter in an inclusive range of approximately 3 mm to approximately 8 mm, in the depicted implementation the first substrate material 106 has a length of approximately 10 mm and a diameter of approximately 4.8 mm (and in some implementations, approximately 7 mm). In the depicted implementation the second substrate material 108 comprises a plurality of tobacco rods formed into a substantially cylindrical portion. Likewise, although in various implementations the size and shape of the second substrate material 108 may vary, for example in some implementations the second substrate material 108 may have a length in an inclusive range of approximately 5 mm to approximately 25 mm, and an overall diameter in an inclusive range of approximately 3 mm to approximately 8 mm, in the depicted implementation the second substrate material 108 has a length of approximately 10 mm and a diameter of approximately 4.8 mm (and in some implementations, approximately 7 mm).

In the depicted implementation, the first and second substrate materials 106, 108 may comprise centrally defined longitudinally extending axes between each of the respective opposed first and second ends, and a cross-section of the first and second substrate materials 106, 108 may be, in some implementations, symmetrical about the axis. For example, in some implementations cross-sections of the first substrate material 106 and the second substrate material 108 may be substantially circular such that the first and second substrate materials 106, 108 define substantially cylindrical shapes extending between the opposed first and second ends thereof. However, in other implementations, the first and second substrate materials 106, 108 may define substantially non-circular cross-sections such that one or both of the first substrate material 106 or the second substrate material 108 may define a substantially non-cylindrical shape between the opposed first and second ends thereof. Otherwise, in other examples, one or both of the first substrate material 106 or the second substrate material 108 may comprise an asymmetric cross-section about the axis. In various implementations, each end of the first and second substrate materials, 106, 108 may be in axial alignment with adjacent elements. For example, the first end of the second substrate material 108 may be configured to be in coaxial alignment with the second end of the first substrate material 106 upon engagement therebetween.

The smoking article of the depicted implementation also includes an intermediate component 110 and at least one filter 112. It should be noted that in various implementations, the intermediate component 110 or the filter 112, individually or together, may be considered a mouthpiece 114 of the smoking article 100. Although in various implementations, neither the intermediate component nor the filter need be included, in the depicted implementation the intermediate component 110 comprises a substantially rigid member that is substantially inflexible along its longitudinal axis. In the depicted implementation, the intermediate component 110 comprises a hollow tube structure, and is included to add structural integrity to the smoking article 100 and provide for cooling the produced aerosol. In some implementations, the intermediate component 110 may be used as a container for collecting the aerosol. In the depicted implementation, the filter 112 is included to filter the aerosol generated by the substrate materials 106 and/or 108 before being inhaled by a user. In various implementations, such a tube may be constructed from any of a variety of materials and may include one or more adhesives. Example materials include, but are not limited to, paper, paper layers, paperboard, plastic, cardboard, and/or composite materials. In the depicted implementation, the intermediate component 110 comprises a hollow cylindrical element constructed of a paper or plastic material (such as, for example, ethyl vinyl acetate (EVA), or other polymeric materials such as poly ethylene, polyester, silicone, etc. or ceramics (e.g., silicon carbide, alumina, etc.), or other acetate fibers), and the filter comprises a packed rod or cylindrical disc constructed of a gas permeable material (such as, for example, cellulose acetate or fibers such as paper or rayon, or polyester fibers). The filter 112 may additionally or alternatively contain strands of tobacco containing material, such as described in U.S. Pat. No. 5,025,814 to Raker et al., which is incorporated herein by reference in its entirety. In various implementations the size and shape of the intermediate component 110 and/or the filter 112 may vary, for example the length of the intermediate component 110 may be in an inclusive range of approximately 10 mm to approximately 30 mm, the diameter of the intermediate component 110 may be in an inclusive range of approximately 3 mm to approximately 8 mm, the length of the filter 112 may be in an inclusive range of approximately 10 mm to approximately 20 mm, and the diameter of the filter 112 may be in an inclusive range of approximately 3 mm to approximately 8 mm. In the depicted implementation, the intermediate component 110 has a length of approximately 20 mm and a diameter of approximately 4.8 mm (and in some implementations, approximately 7 mm), and the filter 112 has a length of approximately 15 mm and a diameter of approximately 4.8 mm (or in some implementations, approximately 7 mm).

In various implementations, the mouthpiece 114 (e.g., the intermediate component 110 and/or the filter 112) is configured to receive the generated aerosol therethrough in response to a draw applied to the mouthpiece 114 by a user. In some implementations, the mouthpiece 114 may be fixedly engaged to the substrate material (such as substrate material 108). For example, an adhesive, a bond, a weld, and the like may be suitable for fixedly engaging the mouthpiece 114 to the substrate material 108. In one example, the mouthpiece 114 is ultrasonically welded and sealed to the second end of the substrate material 108.

As noted, in some implementations the mouthpiece 114 may comprise a filter 112 configured to receive the aerosol therethrough in response to the draw applied to the mouthpiece 114. In various implementations, the filter 112 is provided, in some aspects, as a circular disc radially and/or longitudinally disposed proximate the second end of the intermediate component 108. In this manner, upon draw on the mouthpiece 114, the filter 112 receives the aerosol flowing through the intermediate component 110 of the smoking article 100.

In various implementations, ignition of the heat source 104 results in aerosolization of the aerosol precursor composition associated with the first substrate material 106 and the second substrate material 108. Preferably, the elements of the first substrate material 106 and the second substrate material 108 do not experience thermal decomposition (e.g., charring, scorching, or burning) to any significant degree, and the aerosolized components are entrained in the air that is drawn through the smoking article 100, including the filter 112, and into the mouth of the user.

FIG. 6 illustrates a longitudinal cross-sectional schematic view of a smoking article 200, according to another implementation of the present disclosure. In particular, FIG. 6 illustrates a smoking article 200 that includes an outer wrap 202, a heat source 204, a heat transfer component 205, a first inhalable substance medium 206, a second inhalable substance medium 208, and a filter 212, which may comprise a mouthpiece 214.

In various implementations, the heat source 204 may be configured to generate heat upon ignition thereof. In the depicted implementation, the heat source 204 comprises a combustible fuel element that has a generally cylindrical shape and that incorporates a combustible carbonaceous material. Carbonaceous materials generally have a high carbon content. Preferred carbonaceous materials are composed predominately of carbon, and/or typically have carbon contents of greater than about 60 percent, generally greater than about 70 percent, often greater than about 80 percent, and frequently greater than about 90 percent, on a dry weight basis.

In some instances, the heat source 204 may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate). Although specific dimensions of an applicable heat source may vary, in the depicted implementation, the heat source 204 has a length in an inclusive range of approximately 7 mm to approximately 20 mm, and in some implementations may be approximately 17 mm, and an overall diameter in an inclusive range of approximately 3 mm to approximately 8 mm, and in some implementations may be approximately 4.8 mm (and in some implementations, approximately 7 mm). Although in other implementations, the heat source may be constructed in a variety of ways, in the depicted implementation, the heat source 204 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties.

Although in various implementations, the heat source may have a variety of forms, including, for example, a substantially solid cylindrical shape or a hollow cylindrical (e.g., tube) shape, the heat source 204 of the depicted implementation comprises an extruded monolithic carbonaceous material defining a plurality of grooves (not visible in FIG. 6) extending longitudinally from a first end of the extruded monolithic carbonaceous material to an opposing second end of the extruded monolithic carbonaceous material. Although in the depicted implementation, the grooves are substantially equal in width and depth and are substantially equally distributed about the circumference of the heat source 204, other implementations may include a single groove. Other implementations may include multiple grooves that may be of unequal width and/or depth, and which may be unequally spaced around the circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In another implementation, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source embodiments such as is disclosed in U.S. Pat. App. Pub. No. 2009/0044818 to Takeuchi et al., each of which is incorporated herein by reference in its entirety.

Generally, the heat source is positioned sufficiently near a substrate material having one or more aerosolizable components so that the aerosol formed/volatilized by the application of heat from the heat source to the substrate material (as well as one or more flavorants, medicaments, or the like that are likewise provided for delivery to a user) is deliverable to the user by way of the mouthpiece. That is, when the heat source heats the substrate material, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

In the depicted implementation, the heat transfer component 205 comprises a hollow cylindrical tube having one or both ends closed and that extends through a portion of the heat source 204 and penetrates into a portion of the first substrate material 206. It should be noted that in other implementations, the heat transfer component may comprise a solid rod (such as the heat transfer component 275 shown in FIG. 7). In various implementations, the heat transfer component may extend through any portion of the heat source 204 and may penetrate any portion of a substrate material. In some implementations, the heat transfer component 205 may further extend into a portion of a second substrate material 208. In the depicted implementation, the heat transfer component 205 extends through substantially the full length of the heat source 204 and penetrates substantially the full length of the first substrate material 206.

In the depicted implementation, the heat transfer component 205 is constructed of a copper material coated with an aluminum material. In other implementations, however, the heat transfer component may be constructed of other heat conducting materials, including, for example, stainless steel, brass, copper, aluminum, silver, gold, bronze, graphite, with or without a coating, and combinations thereof. Moreover, any one or any combination of these parts may be constructed of one material (e.g., one conductive material) and coated with another material (e.g., another conductive material). In the depicted implementation, the heat transfer component has a diameter in an inclusive range of approximately 1 mm to approximately 3 mm, an internal diameter in an inclusive range of approximately 0.5 mm to approximately 2.5 mm, and a length in an inclusive range of approximately 10 mm to approximately 35 mm. In such a manner, the heat transfer component 205 facilitates transfer of heat from the heat source 204 to the first substrate material 206 (and, in some implementations, additional substrate materials).

In the depicted implementation, the smoking article 200 also includes a first substrate material 206 having opposed first and second ends, wherein the first end is disposed proximate the heat transfer component 205. Although various implementations may include only one substrate material, in the depicted implementation, a second substrate material 208 is disposed proximate the second end of the first substrate material 206. In other implementations, additional substrate materials may be included. In various implementations, one or more of the substrate materials may include a tobacco or tobacco related material, with an aerosol precursor composition associated therewith. Other possible compositions, components, and/or additives for use in the first substrate material and/or the second substrate material and/or any other substrate materials are described in more detail below.

In some implementations, the substrate material may comprise a blend of flavorful and aromatic tobaccos in cut filler form. In another implementation, the substrate material may comprise a reconstituted tobacco material, such as described in U.S. Pat. No. 4,807,809 to Pryor et al.; U.S. Pat. No. 4,889,143 to Pryor et al. and U.S. Pat. No. 5,025,814 to Raker, the disclosures of which are incorporated herein by reference in their entirety. Additionally, a reconstituted tobacco material may include a reconstituted tobacco paper for the type of cigarettes described in Chemical and Biological Studies on New Cigarette Prototypes that Heat Instead of Burn Tobacco, R. J. Reynolds Tobacco Company Monograph (1988), the contents of which are incorporated herein by reference in its entirety. For example, a reconstituted tobacco material may include a sheet-like material containing tobacco and/or tobacco-related materials. As such, in some implementations, the substrate material may be formed from a wound roll of a reconstituted tobacco material. In another implementation, the substrate material may be formed from shreds, strips, and/or the like of a reconstituted tobacco material.

In some implementations, the substrate material may include a plurality of microcapsules, beads, granules, and/or the like having a tobacco-related material. For example, a representative microcapsule may be generally spherical in shape, and may have an outer cover or shell that contains a liquid center region of a tobacco-derived extract and/or the like. In some implementations, one or more of the substrate materials may include a plurality of microcapsules each formed into a hollow cylindrical shape. In some implementations, one or more of the substrate materials may include a binder material configured to maintain the structural shape and/or integrity of the plurality of microcapsules formed into the hollow cylindrical shape.

Tobacco employed in one or more of the substrate materials may include, or may be derived from, tobaccos such as flue-cured tobacco, burley tobacco, Oriental tobacco, Maryland tobacco, dark tobacco, dark-fired tobacco and *Rustica* tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Pat. App. Pub. No. 2004/0255965 to Perfetti et al.; PCT Pub. No. WO 02/37990 to Bereman; and Bombick et al., *Fund. Appl. Toxicol.,* 39, p. 11-17 (1997); the disclosures of which are incorporated herein by reference in their entireties.

In still another aspect of the present disclosure, the substrate material may be configured as an extruded structure that includes, or is essentially comprised of a tobacco, a tobacco related material, glycerin, water, and/or a binder material, although certain formulations exclude the binder material. The binder material may be any binder material commonly used for tobacco formulations including, for example, carboxymethyl cellulose (CMC), gum (e.g. guar gum), xanthan, pullulan, and/or an alginate. According to some aspects, the binder material included in the substrate material may be configured to substantially maintain a structural shape and/or integrity of the substrate material. Various representative binders, binder properties, usages of binders, and amounts of binders are set forth in U.S. Pat. No. 4,924,887 to Raker et al., which is incorporated herein by reference in its entirety.

In some implementations, the substrate material may be configured as an extruded material, as described in U.S. Pat. App. Pub. No. 2012/0042885 to Stone et al., which is incorporated herein by reference in its entirety. In yet another implementation, the substrate material may include an extruded structure and/or substrate formed from marumarized and/or non-marumarized tobacco. Marumarized tobacco is known, for example, from U.S. Pat. No. 5,105,831 to Banerjee, et al., which is incorporated by reference herein in its entirety. Marumarized tobacco includes about 20 to about 50 percent (by weight) tobacco blend in powder form, with glycerol (at about 20 to about 30 percent weight), calcium carbonate (generally at about 10 to about 60 percent by weight, often at about 40 to about 60 percent by weight), along with binder agents, as described herein, and/or flavoring agents.

In various implementations, the substrate material may take on a variety of conformations based upon the various amounts of materials utilized therein. For example, a sample substrate material may comprise up to approximately 98% by weight, up to approximately 95% by weight, or up to approximately 90% by weight of a tobacco and/or tobacco related material. A sample substrate material may also comprise up to approximately 25% by weight, approximately 20% by weight, or approximately 15% by weight water—particularly approximately 2% to approximately 25%, approximately 5% to approximately 20%, or approximately 7% to approximately 15% by weight water. Flavors and the like (which include, for example, medicaments, such as nicotine) may comprise up to approximately 10%, up to about 8%, or up to about 5% by weight of the aerosol delivery component.

Additionally or alternatively, the substrate material may be configured as an extruded structure and/or a substrate that includes or essentially is comprised of tobacco, glycerin, water, and/or binder material, and is further configured to substantially maintain its structure throughout the aerosol-generating process. That is, the substrate material may be configured to substantially maintain its shape (e.g., the substrate material does not continually deform under an applied shear stress) throughout the aerosol-generating process. Although such an example substrate material may include liquids and/or some moisture content, the substrate may remain substantially solid throughout the aerosol-generating process and may substantially maintain structural integrity throughout the aerosol-generating process. Example tobacco and/or tobacco related materials suitable for a substantially solid substrate material are described in U.S. Pat. App. Pub. No. 2015/0157052 to Ademe et al.; U.S. Pat. App. Pub. No. 2015/0335070 to Sears et al.; U.S. Pat. No. 6,204,287 to White; and U.S. Pat. No. 5,060,676 to Hearn et al., which are incorporated herein by reference in their entirety.

In some implementations, the amount of substrate material that is used within the smoking article may be such that the article exhibits acceptable sensory and organoleptic properties, and desirable performance characteristics. For example, in some implementations sufficient aerosol precursor composition such as, for example, glycerin and/or propylene glycol, may be employed within the substrate material in order to provide for the generation of a visible mainstream aerosol that in many regards resembles the appearance of tobacco smoke. For example, the amount of aerosol precursor composition incorporated into the substrate material of the smoking article may be in the range of about 3.5 grams or less, about 3 grams or less, about 2.5 grams or less, about 2 grams or less, about 1.5 grams or less, about 1 gram or less, or about 0.5 gram or less.

According to another implementation, a smoking article according to the present disclosure includes a substrate material comprising a porous, inert material such as, for example, a ceramic material. In another aspect, the aerosol delivery component includes a porous, inert material that does not substantially react, chemically and/or physically, with a tobacco-related material such as, for example, a tobacco-derived extract.

As noted above, in various implementations one or more of the substrate materials may include a tobacco, a tobacco component, and/or a tobacco-derived material that has been treated, manufactured, produced, and/or processed to incorporate an aerosol precursor composition (e.g., humectants such as, for example, propylene glycol, glycerin, and/or the like) and/or at least one flavoring agent, as well as a burn retardant (e.g., diammonium phosphate and/or another salt) configured to help prevent ignition, pyrolysis, combustion, and/or scorching of the aerosol delivery component by the heat source. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

In some implementations, flame/burn retardant materials and other additives that may be included within one or more of the substrate materials may include organo-phosophorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides are suitable but are not preferred agents. In each aspect of flame-retardant, burn-retardant, and/or scorch-retardant materials used in the aerosol delivery component and/or other components (whether alone or in combination with each other and/or other materials), the desirable properties most preferably are provided without undesirable off-gassing or melting-type behavior.

According other implementations of the present disclosure, the substrate material may also incorporate tobacco additives of the type that are traditionally used for the manufacture of tobacco products. Those additives may include the types of materials used to enhance the flavor and aroma of tobaccos used for the production of cigars, cigarettes, pipes, and the like. For example, those additives may include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials may include water, sugars and syrups (e.g., sucrose, glucose and high fructose corn syrup), humectants (e.g. glycerin or propylene glycol), and flavoring agents (e.g., cocoa and licorice). Those added components may also include top dressing materials (e.g., flavoring materials, such as menthol). See, for example, U.S. Pat. No. 4,449,541 to Mays et al., the disclosure of which is incorporated herein by reference in its entirety. Further materials that may be added include those disclosed in U.S. Pat. No. 4,830,028 to Lawson et al. and U.S. Pat. No. 8,186,360 to Marshall et al., the disclosures of which are incorporated herein by reference in their entireties.

As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, an aerosol delivery component may produce a visible aerosol upon the application of sufficient heat thereto (and cooling with air, if necessary), and the aerosol delivery component may produce an aerosol that is "smoke-like." In other aspects, the aerosol delivery component may produce an aerosol that is substantially non-visible but is recognized as present by other characteristics, such as flavor or texture. Thus, the nature of the produced aerosol may be variable depending upon the specific components of the aerosol delivery component. The aerosol delivery component may be chemically simple relative to the chemical nature of the smoke produced by burning tobacco.

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

Flavoring agents may also include acidic or basic characteristics (e.g., organic acids, such as levulinic acid, succinic acid, and pyruvic acid). In some implementations, flavoring agents may be combinable with the elements of the substrate material if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material. For example, organic acids, such as levulinic acid, lactic acid, and pyruvic acid, may be included in the substrate material with nicotine in amounts up to being equimolar (based on total organic acid content) with the nicotine. Any combination of organic acids may be suitable. For example, in some implementations, the substrate material may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the substrate material. Various additional examples of organic acids employed to produce an aerosol delivery component are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the first substrate material 206 may include other materials having a variety of inherent characteristics or properties. For example, the first substrate material 206 may comprise a plasticized material or regenerated cellulose in the form of rayon. As another example, viscose (commercially available as VISIL®), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

The smoking article 200 of the depicted implementation also includes a heat transfer cap 207 that is configured to cover an end of the heat source 204 proximate the first substrate material 106. In some implementations, the cap 207 may be pressed onto the end of the heat source 204. In the depicted implementation, the heat transfer cap 207 includes an end portion 207A that covers substantially the entire end of the heat source 204 proximate the first substrate material 206, and a rim portion 207B that extends upward and peripherally around at least a portion of the length of the heat source 204. In the depicted implementation, the rim portion 207B of the heat transfer cap 207 extends approximately ⅓ to ½ of the length of the heat source 204. In the depicted implementation, the heat transfer cap 207 is constructed of the same material as the heat transfer component 205. However, in other implementations, one or both the heat transfer component 505 or the heat transfer cap 507 may be constructed of another material, as described herein. In addition, in various implementations, one or both the heat transfer component 205 or the heat transfer cap 207 may be constructed of one material (e.g., one conductive material) and coated with another material (e.g., another conductive material). In the depicted implementation, the heat transfer component 205 extends through a portion of the heat source 204 and penetrates into a portion of the first substrate material 206, and in particular, substantially the entire length of the first substrate material 206. However, in other implementations, the heat transfer component 205 may extend through any portion of the heat source 204 and may penetrate any portion of a first substrate material, and, in some implementations, may further extend into a portion of a second substrate material.

As noted above, in some implementations, the smoking article 200 may further comprise a second substrate material 208 having opposed first and second ends. In various implementations, the second substrate material 208 may comprise a centrally defined longitudinally extending axis between each of the opposed first and second ends. Like the first substrate material 206 in some implementations, a cross-section of the second substrate material 208 may be, in some implementations, symmetrical about the axis. For example, in some implementations cross-sections of the first substrate material 206 and the second substrate material 208 may be substantially circular such that the first and second substrate materials 206, 208 define substantially cylindrical shapes extending between the opposed first and second ends thereof. However, in other implementations, the first and second substrate materials 206, 208 may define substantially non-circular cross-sections such that one or both of the first substrate material 206 or the second substrate material 208 may define a substantially non-cylindrical shape between the opposed first and second ends thereof. Otherwise, in other examples, one or both of the first substrate material 206 or the second substrate material 208 may comprise an asymmetric cross-section about the axis. In various implementations, each end of the first and second substrate materials, 206, 208 may be axial alignment with adjacent elements. For example, the first end of the second substrate material 208 may be configured to be in coaxial alignment with the second end of the first substrate material 206 upon engagement therebetween.

In various implementations, ignition of the heat source 204 results in aerosolization of the aerosol precursor composition associated with each of the first substrate material 206 and the second substrate material 208. Preferably, the elements of the first substrate material 206 and the second substrate material 208 do not experience thermal decomposition (e.g., charring, scorching, or burning) to any significant degree, and the aerosolized components are entrained in the air that is drawn through the smoking article 200, including the filter 212, and into the mouth of the user.

Referring back to FIG. 6, the outer wrap 202 is provided to engage or otherwise join together at least a portion of the heat source 204 with the first substrate material 206, the second substrate material 208, and at least a portion of the mouthpiece 214. As such, the outer wrap material 202 is configured, in some aspects, to circumscribe, e.g., coaxially encircle, at least a portion of the heat source 204, the first substrate material 206 engaged about the first end thereof with the heat source 204, the second substrate material 208 engaged with the second end of the first substrate material 206, and at least a portion of the mouthpiece 214. The outer wrap 202 is configured to be retained in a wrapped position in any manner of ways including via an adhesive, or a fastener, and the like, to allow the outer wrap 202 to remain in the wrapped position. Otherwise, in some other aspects, the outer wrap 202 may be configured to be removable as desired. For example, upon retaining the outer wrap 202 in a wrapped position, the outer wrap 202 may be able to be removed from the heat source 204, the first substrate material 206 engaged with the heat source 204 about the first end thereof, the second substrate material 208 engaged with the second end of the first substrate material 206, and a portion of the mouthpiece 214. In this example, the adhesive, fastener, or the like is removed and the outer wrap material 202 is uncircumscribed thereabout.

As shown in the figure, in addition to the outer wrap 202, the depicted implementation also includes a liner 218 that is configured to circumscribe the first substrate material 206 and at least a portion of the heat source 204. In some implementations, the liner 218 may also circumscribe the second substrate material 208. In some implementations, the outer wrap material 202 may include the liner 218. As such, in some implementations the outer wrap material 202 and the liner 218 may be separate materials that are provided together (e.g., bonded, fused, or otherwise joined together as a laminate). In other instances, the outer wrap 202 and the liner 218 may be the same material. In any event, the liner 218 may be configured to thermally regulate conduction of the heat generated by the ignited heat source 204, radially outward of the liner 218. As such, in some implementations, the liner 218 may be constructed of a foil material, a graphene material, a graphite material, and/or an aluminum material, and in any event, the material may be laminate. In the depicted implementations, the liner is constructed of an aluminum laminate. In some implementations, depending on the material of the outer wrap 202 and/or the liner 218, a thin layer of insulation may be provided radially outward of the liner 218. Thus, the liner 218 advantageously provides, in some aspects, a manner of engaging two or more separate components of the smoking article 200 (such as, for example, the heat source 204 and the first substrate material 206), while also providing a manner of facilitating heat transfer axially therealong, but restricting radially outward heat conduction.

As also shown in FIG. 6, the outer wrap 202 (and, as necessary, the liner 218, and the first substrate material 206) may also include one or more openings 220 formed therethrough that allow the entry of air upon a draw on the mouthpiece 214. In some implementations, the openings 220 may be located between the distal end of the heat transfer component 205 and the first substrate material 206. In some implementations, the openings 220 may be formed in the outer wrap 202 (and, in some implementations, the liner 218) in an area proximate the first substrate material 206, and separate cooling openings 221 may be formed in the outer wrap 202 (and, in some implementations, the liner 218) in an area proximate the filter 212. In the depicted implementation, a plurality of substantially evenly spaced openings 220 are formed in the outer wrap 202 and liner 218 in an area proximate the first substrate material 206, and a plurality of substantially even spaced separate cooling openings 221 are formed in the outer wrap 202 in an area proximate the mouthpiece 214 (e.g., in the depicted implementation, proximate the filter 212). Although in various implementations the openings may be formed through the outer wrap 202 (and the liner 218) in a variety of ways, in the depicted implementation, the plurality of openings 220 are formed via laser perforation.

In the smoking article 200 of the depicted implementation, the first substrate material 206 comprises a plurality of tobacco beads formed into a substantially cylindrical portion. Although, as noted above, in various implementations the size and shape of the first substrate material may vary, for example the first substrate material 206 may have a length in an inclusive range of approximately 5 mm to approximately 15 mm, and an overall diameter in an inclusive range of approximately 3 mm to approximately 8 mm, in the depicted implementation the first substrate material has a length of approximately 10 mm and a diameter of approximately 4.8 mm (and in some implementations, approximately 7 mm). In the depicted implementation the second substrate material 208 comprises a plurality of tobacco rods formed into a substantially cylindrical portion. Likewise, although in various implementations the size and shape of the second substrate material 108 may vary, for example in some implementations the second substrate material 208 may have a length in an inclusive range of approximately 5 mm to approximately 25 mm, and an overall diameter in an inclusive range of approximately 3 mm to approximately 8 mm, in the depicted implementation the second substrate material 208 has a length of approximately 30 mm and a diameter of approximately 4.8 mm (and in some implementations, approximately 7 mm).

The smoking article of the depicted implementation also includes a filter 212. It should be noted that in various implementations, the smoking article may also include an intermediate component, such as the intermediate component described above. In various implementations, the filter 212, individually or together with another component, may be considered a mouthpiece 214 of the smoking article 200. It should be noted that in various implementations, neither the intermediate component nor the filter need be included. In the depicted implementation, however, the filter 212 is included to filter the aerosol generated by the substrate materials 206 and/or 208 before being inhaled by a user. In the depicted implementation, the filter comprises a packed rod or cylindrical disc constructed of a gas permeable material (such as, for example, cellulose acetate or fibers such as paper or rayon, or polyester fibers). The filter 112 may additionally or alternatively contain strands of tobacco containing material, such as described in U.S. Pat. No. 5,025,814 to Raker et al., which is incorporated herein by reference in its entirety. Although in various implementations the size and shape of the filter 212 may vary, for example the length of the intermediate component 110 may be in an inclusive range of approximately 10 mm to 30 mm, the diameter of the intermediate component 110 may be in an inclusive range of approximately 3 mm to 8 mm, the length of the filter 112 may be in an inclusive range of approximately 10 mm to 20 mm, and the diameter of the filter 112 may be in an inclusive range of approximately 3 mm to 8 mm. In the depicted implementation, the filter 112 has a length of approximately 15 mm and a diameter of approximately 4.8 mm (and in some implementations, approximately 7 mm).

In various implementations, the mouthpiece 214 (e.g., the filter 212) is configured to receive the generated aerosol therethrough in response to a draw applied to the mouthpiece 214 by a user. In some implementations, the mouthpiece 214 may be fixedly engaged to the substrate material (such as substrate material 208). For example, an adhesive, a bond, a weld, and the like may be suitable for fixedly engaging the mouthpiece 214 to the substrate material 208. In one example, the mouthpiece 214 is ultrasonically welded and sealed to the second end of the substrate material 208.

As noted, in some implementations the mouthpiece 214 may comprise a filter 212 configured to receive the aerosol therethrough in response to the draw applied to the mouthpiece 214. In various implementations, the filter 212 is provided, in some aspects, as a circular disc radially and/or longitudinally disposed proximate the second end of the second substrate material 208. In this manner, upon draw on the mouthpiece 214, the filter 212 receives the aerosol flowing through the intermediate component 210 of the smoking article 200.

FIG. 7 illustrates a cross-sectional schematic view of a heat source and a heat transfer component of a smoking article, according to another implementation of the present disclosure. In particular, FIG. 7 illustrates a heat source 504 and a heat transfer component 505 that includes a heat transfer cap 507. In various implementations, the heat source 504 of the depicted implementation may be similar to the heat sources described above, and thus reference is made to the various heat source implementations described herein. In the depicted implementation, the heat transfer component 505 comprises a solid cylinder that extends through the heat source 504. As noted above, in other implementations, the heat transfer component may have other geometric configurations, including, for example, a tube, rod, sheet, or mesh. In the depicted implementations, the heat transfer component 505 is constructed of aluminum; however, as also noted above, in other implementations, the heat transfer component 505 may be constructed of other heat conducting materials, including, for example, stainless steel, brass, copper, silver, gold, bronze, graphite, and combinations thereof.

The implementation depicted in FIG. 7 also includes a heat transfer cap 507 that is configured to cover an end of the heat source 504 proximate the substrate material. In the depicted implementation, the heat transfer cap 507 includes an end portion 507A that covers substantially the entire end of the heat source 504 proximate the substrate material, and a rim portion 507B that extends upward and peripherally around at least a portion of the length of the heat source 504.

In the depicted implementation, the rim portion 507B of the heat transfer cap 507 extends approximately ⅓ to approximately ½ of the length of the heat source 504. In the depicted implementation, the heat transfer cap 507 is constructed of the same material (e.g., aluminum) as the heat transfer component 505. However, in other implementations, one or both the heat transfer component 505 or the heat transfer cap 507 may be constructed of another material, as described above. In addition, in various implementations, one or both the heat transfer component 505 or the heat transfer cap 507 may be constructed of one material (e.g., one conductive material) and coated with another material (e.g., another conductive material).

In the depicted implementation, the heat transfer component 505 extends through a portion of the heat source 504 and penetrates into a portion of the first substrate material (see above). In various implementations, the heat transfer component 505 may extend through any portion of the heat source 504 and may penetrate any portion of a substrate material. In some implementations, the heat transfer component may further extend into a portion of a second substrate material.

FIG. 8 illustrates schematic views of various heat transfer components of a smoking article, according to some other example implementations of the present disclosure. In particular, FIG. 8 illustrates a heat transfer component 275, according to one implementation of the present disclosure, as well as heat transfer component 305, according to another example implementation of the present disclosure, and heat transfer component 405, according to still another example implementation of the present disclosure. In various implementations, each of the illustrated heat transfer components 275, 305, 405 is configured to facilitate the transfer of heat from a heat source to one or more downstream substrate materials.

Heat transfer component 275 of the present disclosure comprises a solid cylindrical tube or rod 275A constructed of a copper material, that includes a coating 275B comprising an aluminum material, although it should be noted that in other implementations, the cylindrical rod 275A and the coating 275B may be constructed of other materials, as noted above. Heat transfer component 305 differs in that it comprises a sheet 305A constructed of a copper material, that includes a coating 305B comprising an aluminum material, although it should be noted that in other implementations, the sheet 305A and the coating 305B may be constructed of other materials, as noted above. For example, in some implementations, the coating 305B may comprise laminated sheets of aluminum on a copper body sheet. Although not shown in the figure, in various implementations the heat transfer component 275 and 305 may also include a heat transfer cap as described above. In still other implementations, heat transfer component 275 and/or the sheet 305A may be constructed of an aluminum material and may not include a coating.

Heat transfer component 405 differs in that it comprises a mesh 405A comprising an aluminum material, that includes an extension 405B, located along the length thereof, which also comprises an aluminum material. It should be noted that in other implementations one or both of the mesh 405A or the extension 405B may be constructed of another material, as noted above. Although in the depicted implementation, the mesh 405A has a substantially cylindrical shape (e.g., having a circular cross-section), in various other implementations, the mesh 405A may have other geometric configurations (such as, for example, a substantially square, substantially rectangular, or substantially triangular cross-section). Likewise, although in the depicted implementation the extension 405B has a disc shape, in various other implementations, the extension 405B may have another shape (such as, for example, a substantially square or substantially triangular shape). In addition, although in various implementations the heat transfer component 405 may be configured such that the extension 405B has any location along the heat source 204 and/or the substrate material 206, in the depicted implementation the extension 405B is configured to be positioned between the heat source 204 and the substrate material 206.

FIG. 9 illustrates a longitudinal cross-sectional schematic view of a smoking article 700, according to another implementation of the present disclosure. In particular, FIG. 9 depicts a smoking article 700 that includes a heat source 704, a heat transfer component 705, a first inhalable substance medium 706, a second inhalable substance medium 708, an intermediate component 710, and a filter 712. In the depicted implementation, the intermediate component 710 and the filter 712 together comprise a mouthpiece 714. The smoking article 700 of the depicted implementation also includes a passageway 717 that is formed through the heat source 704 and through which the hollow structure of the heat transfer component 705 passes. As shown in the figure, in addition to the outer wrap 702, the depicted implementation also includes a liner 718 that is configured to circumscribe the first substrate material 706 and at least a portion of the heat source 704. As also shown in the figure, the outer wrap 702 (and, as necessary, the liner 718, and the first substrate material 706) may also include one or more openings 720 formed therethrough that allow the entry of air upon a draw on the mouthpiece 714. One or more separate cooling openings 721 may also be formed in the outer wrap 702 in an area proximate the filter 712.

In many respects, the implementation of FIG. 9 is similar to that of FIG. 3, and thus reference is made to the descriptions above regarding the various possible components of the smoking article. One way in which the implementation of FIG. 9 differs from that of FIG. 3 is that the first substrate material 706 has an extruded hollow form that includes a passageway 707 formed therethrough. Although in the depicted implementation the diameter of the first substrate material passageway 707 is substantially the same as the passageway 717 formed through the heat source 704, it should be noted that in various other implementations the diameter of the passageway 707 may differ. Thus in some implementations, the diameter of the first substrate material passageway 707 may be smaller than the diameter of the passageway 717 formed through the heat source 704, and in other implementations, the diameter of the first substrate material passageway 707 may be larger than the diameter of the passageway 717 formed through the heat source 704.

FIG. 10 illustrates a longitudinal cross-sectional schematic view of a smoking article 800, according to another implementation of the present disclosure. In particular, FIG. 10 depicts a smoking article 800 that includes a heat source 804, a heat transfer component 805, a first inhalable substance medium 806, an intermediate component 810, and a filter 812. In the depicted implementation, the intermediate component 810 and the filter 812 together comprise a mouthpiece 814. The smoking article 800 of the depicted implementation also includes a passageway 817 that is formed through the heat source 804 and through which the hollow structure of the heat transfer component 805 passes. As shown in the figure, in addition to the outer wrap 802, the depicted implementation also includes a liner 818 that is configured to circumscribe the first substrate material 806 and at least a portion of the heat source 804. As also shown in the figure, the outer wrap 802 (and, as necessary, the liner 818, and the first substrate material 806) may also include one or more openings 820 formed therethrough that allow the entry of air upon a draw on the mouthpiece 814. One or more separate cooling openings 821 may also be formed in the outer wrap 702 in an area proximate the filter 812.

In many respects, the implementation of FIG. 10 is similar to that of FIG. 3, and thus reference is made to the descriptions above regarding the various possible components of the smoking article. One way the implementation of FIG. 10 differs from that of FIG. 3 is that the first substrate material 806 has an extruded hollow form that includes a passageway 807 formed therethrough. Although in the depicted implementation the diameter of the first substrate material passageway 807 is substantially the same as the passageway 817 formed through the heat source 804, it should be noted that in various other implementations the diameter of the passageway 807 may differ. Thus in some implementations, the diameter of the first substrate material passageway 807 may be smaller than the diameter of the passageway 817 formed through the heat source 804, and in other implementations, the diameter of the first substrate material passageway 807 may be larger than the diameter of the passageway 817 formed through the heat source 804.

Another way the implementation of FIG. 10 differs from that of FIG. 3 is that the implementation of FIG. 10 does not include a second substrate material. Thus, in some implementations the length of the first substrate material 806 and/or the length of the intermediate component 810 may be longer if it is desired to provide a smoking article of the same overall length. In the depicted implementation, the length of the intermediate component 810 has been increased to compensate for the lack of a second substrate material.

FIG. 11 illustrates a longitudinal cross-sectional schematic view of a smoking article 900, according to another implementation of the present disclosure. In particular, FIG. 11 depicts a smoking article 900 that includes a heat source 904, a heat transfer component 905, a first inhalable substance medium 906, a second inhalable substance medium 908, an intermediate component 910, and a filter 912. In the depicted implementation, the intermediate component 910 and the filter 912 together comprise a mouthpiece 914. The smoking article 900 of the depicted implementation also includes a passageway 917 that is formed through the heat source 904 and through which the hollow structure of the heat transfer component 905 passes. As shown in the figure, in addition to the outer wrap 902, the depicted implementation also includes a liner 918 that is configured to circumscribe the first substrate material 906 and at least a portion of the heat source 904. As also shown in the figure, the outer wrap 902 (and, as necessary, the liner 918, and the first substrate material 906) may also include one or more openings 920 formed therethrough that allow the entry of air upon a draw on the mouthpiece 914. One or more separate cooling openings 921 may also be formed in the outer wrap in an area proximate the filter 712.

In many respects, the implementation of FIG. 11 is similar to that of FIG. 3, and thus reference is made to the descriptions above regarding the various possible components of the smoking article. One way in which the implementation of FIG. 11 differs from that of FIG. 3 is that the hollow structure of the heat transfer component 905 extends past the distal flange and into at least a portion of the first substrate material 906. In other implementations, the hollow structure of the heat transfer component 905 may extend through the first substrate material 906 and into the second substrate material 908.

Although a smoking article according to the disclosure may take on a variety of implementations, as discussed in detail herein, the use of the smoking article by a consumer will be similar in scope. The foregoing description of use of the smoking article is applicable to the various implementations described through minor modifications, which are apparent to the person of skill in the art in light of the further disclosure provided herein. The description of use, however, is not intended to limit the use of the inventive article but is provided to comply with all necessary requirements of disclosure herein.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A smoking article comprising:

a heat source configured to generate heat upon ignition thereof;

a substrate material having opposed first and second ends, the heat source being disposed proximate the first end of the substrate material, and the substrate material having an aerosol precursor composition associated therewith;

a mouthpiece, the mouthpiece being disposed proximate the second end of the substrate material; and a heat transfer component comprising a hollow structure and including opposing first and seconds flanges located on respective ends thereof, wherein the hollow structure of the heat transfer component extends through the heat source such that the heat source is located between the first and second opposing flanges of the heat transfer component, and wherein the hollow structure is configured to permit the passage of air therethrough.

2. The smoking article of claim 1, wherein the substrate material comprises at least one of tobacco-containing beads, tobacco shreds, tobacco strips, pieces of a reconstituted tobacco material, tobacco rods, and non-tobacco materials.

3. The smoking article of claim 1, further comprising a liner configured to circumscribe the substrate material and at least a portion of the heat source.

4. The smoking article of claim 1, further comprising one or more perforations located in the substrate material, the perforations being configured to facilitate airflow through the smoking article.

5. The smoking article of claim 1, further comprising a second substrate material having opposed first and second ends, the second substrate material being disposed between the first substrate material and the mouthpiece.

6. The smoking article of claim 5, wherein the second substrate material comprises at least one of tobacco-containing beads, tobacco shreds, tobacco strips, pieces of a reconstituted tobacco material, or tobacco rods.

7. The smoking article of claim 1, wherein the mouthpiece comprises an intermediate component.

8. The smoking article of claim 1, wherein the mouthpiece comprises a filter.

9. The smoking article of claim 1, wherein the heat source comprises an extruded monolithic carbonaceous material.

10. The smoking article of claim 9, wherein the extruded monolithic carbonaceous material defines one or more grooves extending longitudinally from a first end of the extruded monolithic carbonaceous material to an opposing second end of the extruded monolithic carbonaceous material.

11. The smoking article of claim 1, wherein the substrate material comprises a series of overlapping layers of an initial substrate sheet.

12. The smoking article of claim 1, wherein the first and second flanges are attached to the hollow structure.

13. The smoking article of claim 1, wherein the first and second flanges and the hollow structure are constructed of the same material.

14. The smoking article of claim 1, wherein the first and second flanges are constructed of a different material than the hollow structure.

15. The smoking article of claim 1, wherein the hollow structure is in the form of a hollow tube.

* * * * *